US006986665B2

(12) United States Patent
Schauz et al.

(10) Patent No.: US 6,986,665 B2
(45) Date of Patent: Jan. 17, 2006

(54) PLUG CONNECTOR HAVING A ROTATABLE OUTGOING CABLE PART

(75) Inventors: Stephan Schauz, Geislingen/Stg. (DE); Manfred Schütte, Deizisau (DE); Barbara Günthner, Wernau (DE)

(73) Assignee: Festo AG & Co., Esslingen (DE)

( * ) Notice: Subject to any disclaimer, the term of this patent is extended or adjusted under 35 U.S.C. 154(b) by 0 days.

(21) Appl. No.: 10/694,422

(22) Filed: Oct. 27, 2003

(65) Prior Publication Data

US 2004/0102060 A1 May 27, 2004

(30) Foreign Application Priority Data

Nov. 27, 2002 (EP) ..... 02026276

(51) Int. Cl.
*H01R 39/00* (2006.01)

(52) U.S. Cl. ..... 439/21; 439/22; 439/13

(58) Field of Classification Search ..... 439/21, 439/22, 27, 314, 317, 446, 651, 653
See application file for complete search history.

(56) References Cited

U.S. PATENT DOCUMENTS

| | | | | |
|---|---|---|---|---|
| 5,037,322 | A | 8/1991 | Adams et al. | 439/357 |
| 5,547,305 | A * | 8/1996 | Treche | 403/97 |
| 5,551,882 | A * | 9/1996 | Whiteman et al. | 439/21 |
| 6,358,077 | B1 * | 3/2002 | Young | 439/321 |

FOREIGN PATENT DOCUMENTS

WO WO 97/02630 1/1997

* cited by examiner

*Primary Examiner*—Chandrika Prasad
(74) *Attorney, Agent, or Firm*—Hoffmann & Baron, LLP

(57) ABSTRACT

An electromechanical plug device is designed with a mating plug connector for electrical and mechanical connection with a mating plug connector. The plug connector comprises an outgoing cable part with a circuit substrate and a contact carrying drum able to be moved in relation to the outgoing cable part. The drum possesses first plug contacts for making contact with second plug contacts formed on the mating plug connector. Moreover, the first plug contacts have first abutment type contact faces provided on the axial rear side of the outgoing cable part, such abutment type contact faces so cooperating with second abutment type contact faces provided on the circuit substrate that the outgoing cable part is able to be positioned at different angular settings in relation to the contact carrying drum.

22 Claims, 19 Drawing Sheets

PLUG CONNECTOR HAVING A ROTATABLE OUTGOING CABLE PART

BACKGROUND OF THE INVENTION

The invention relates to an electromechanical plug device having a plug connector adapted for electrical and mechanical connection with a mating plug connector, such plug device having a rotatable outgoing cable part.

In the electromechanical plug device art there is frequently the problem that the cable leaving the plug connector, more especially if it is a case of an angled plug, has an inconvenient shape and collides with adjacent components. This is the case for example for plug devices which are employed making electrical contact with sensors in connection with position detecting means in fluid power drives. Frequently the outgoing cables are then bent around sharply in order to avoid obstacles and this may lead to damage.

SHORT SUMMARY OF THE INVENTION

One object of the invention is accordingly to provide an electromechanical plug device by means of which the danger of damage in conjunction with the outgoing cable of the plug device may be reduced.

In order to achieve these and/or other objects appearing from the present specification, claims and drawings, in the present invention an electromechanical plug device comprises a plug connector, which is adapted for electrical and mechanical connection with a mating plug connector and which possesses an outgoing cable part having a circuit substrate provided for electrical connection with an outgoing cable and also possesses a contact carrying drum supported for rotation about its longitudinal axis, the contact carrying drum having first plug contacts, which are accessible from the front axial side facing away from the outgoing cable part, of the contact carrying drum in order as part of a plugging movement, taking place in the direction of the longitudinal axis of the contact carrying drum, to be able to be contacted electrically by second plug contacts of the mating plug connector and which on the axial rear side, facing the outgoing cable part, of the contact carrying drum are provided with first abutment type contact faces, which irrespectively the instantaneous relative position of rotation of the outgoing cable part and the contact carrying drum are contacted or are able to be contacted by second abutment type contact faces provided axially oppositely on the circuit substrate.

Accordingly after the electromechanical connection has been produced only the relative position between the contact carrying drum bearing the first plug contacts and the contacted mating plug connector is set in advance, whereas the outgoing cable part is able to be positioned at different angles of rotation in relation to the contact carrying drum and accordingly furthermore in relation to the mating plug connector in an adaptable manner in order to align the outgoing cable as may be desired. The rotatability is admittedly an advantage even in the case of a coaxial arrangement of the outgoing cable, because then twisting of the outgoing cable may be prevented. It is more particularly advantageous however for the arrangement to be provided in the case of plug connectors, which are designed in the form of angular or elbow plugs so that the outgoing cable is orientated athwart the longitudinal axis of the contact carrying drum. The electrical connection is now produced between the contact carrying drum and the outgoing cable part using first and second abutment type contact faces on the axial rear side of the contact carrying drum on the one hand and on the other hand with a circuit substrate connected or to be connected of the plug connector, and between associated pairs of first and second abutment type contact faces both a constant contact is possible or contact is only possible when the electromechanical connection is made, and beforehand during the angular alignment of the outgoing cable part, in order to avoid wear, there is as yet no electrical contact between the first and the second abutment type contact faces.

Further advantageous developments of the invention are defined in the claims.

It is convenient for the first and/or second abutment type contact faces to be at least partially in a circular or circularly arcuate form whose center of curvature is on the longitudinal axis of the contact carrying drum.

By suitably adaptable design of the circuit substrate different forms of layout are possible in an extremely simple fashion. The circuit substrate may for example be in the form of a printed circuit board or in the form of a 3D molded interconnect device (MID) substrate structure.

It is more especially advantageous to have a design in the case of which there is unlimited rotatability between the outgoing cable part and the contact carrying drum. This means that unlimited angular positioning is possible.

In the case of a preferred working embodiment the contact carrying drum is able to be moved in the direction of its longitudinal axis in relation to the outgoing cable part to a limited extent, it being so drawn axially clear of the circuit substrate when the mating plug connector is not connected that the first and the second abutment type contact faces are clear of one another. The axial mobility may for example amount to a few tenths of a millimeter. The outgoing cable part may in this condition be extremely readily turned and positioned. It is only on final fixing of the mating plug connector in position that the contact carrying drum is shifted through the mating plug connector toward the circuit substrate so that the first and the second abutment type contact faces are thrust firmly against each other to produce an electrical connection. Owing to such mutual thrusting together it is possible to simultaneously achieve a certain degree of locking in rotation of the outgoing cable part in relation to the contact carrying drum so that small constantly occurring rotary movements leading to wear may be prevented.

The angular fixation may be improved if an interlocking or toothed surface is provided on the contact carrying drum, which in the condition acted upon by the mating plug connector of the contact carrying drum interlocks with the outgoing cable part to secure the set angular position.

In principle there is the possibility of producing the first plug contacts in stamping and bending technology or in the form of metal inlay bushings. A essentially improved adaptability is achieved with a integration of the first plug contacts however if the contact carrying drum is in the form of a 3D-MID-component, in which case the first plug contacts are at least in part constituted by electrical conductors produced using MID technology.

The plug device may be such that the plug connector possesses channel-like plug sockets, which may be slipped over pin-like contacts of the mating plug connector. However it is possible as well to have a reversal of parts by having contact pins on the contact carrying drum, which during the production of the plug connection are inserted into second bushing-like plug contacts on the mating plug connector.

Between on the one hand the outgoing cable part and on the other hand both the contact carrying drum and also the mating plug connector it is possible in a relatively simple manner for reliable sealing means to be provided on the outgoing cable part, by the formation of annular sealing projections, such sealing means preventing entry of dirt or liquid into the regions, which are critically important for making contact, of the plug device. In this manner it is at least possible to achieve the sealing standard IP 65.

All in all the plug device renders possible a small overall height in the direction of the longitudinal axis of the contact carrying drum. Furthermore, if desired the number of necessary separate parts may be kept extremely low.

Further advantageous developments and convenient forms of the invention will be understood from the following detailed descriptive disclosure of embodiments thereof in conjunction with the accompanying drawings.

LIST OF THE SEVERAL VIEWS OF THE FIGURES.

Figure 18:
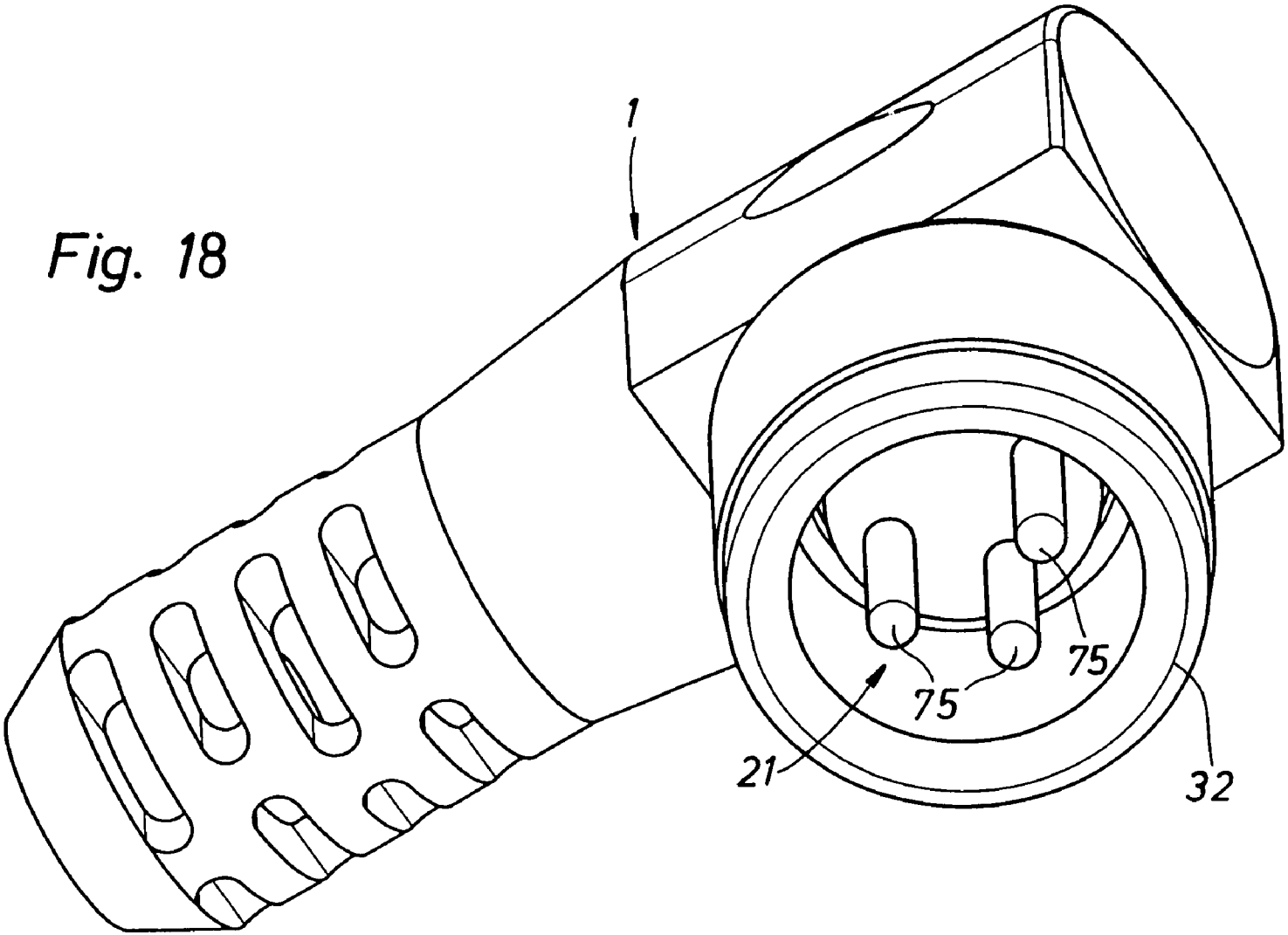

FIG. 18 shows a plug connector, also in the form of an elbow plug connector, of a further modification of the plug connector in accordance with the invention in a perspective representation as seen obliquely from below, in the case of which, departing from the structure illustrated so far, the components, designed for contacting the mating plug connector, are in the form of pins, which serve as contact pins, which serve for insertion in bushing-like second plug contacts of the mating plug connector, which is not illustrated.

Figure 19:
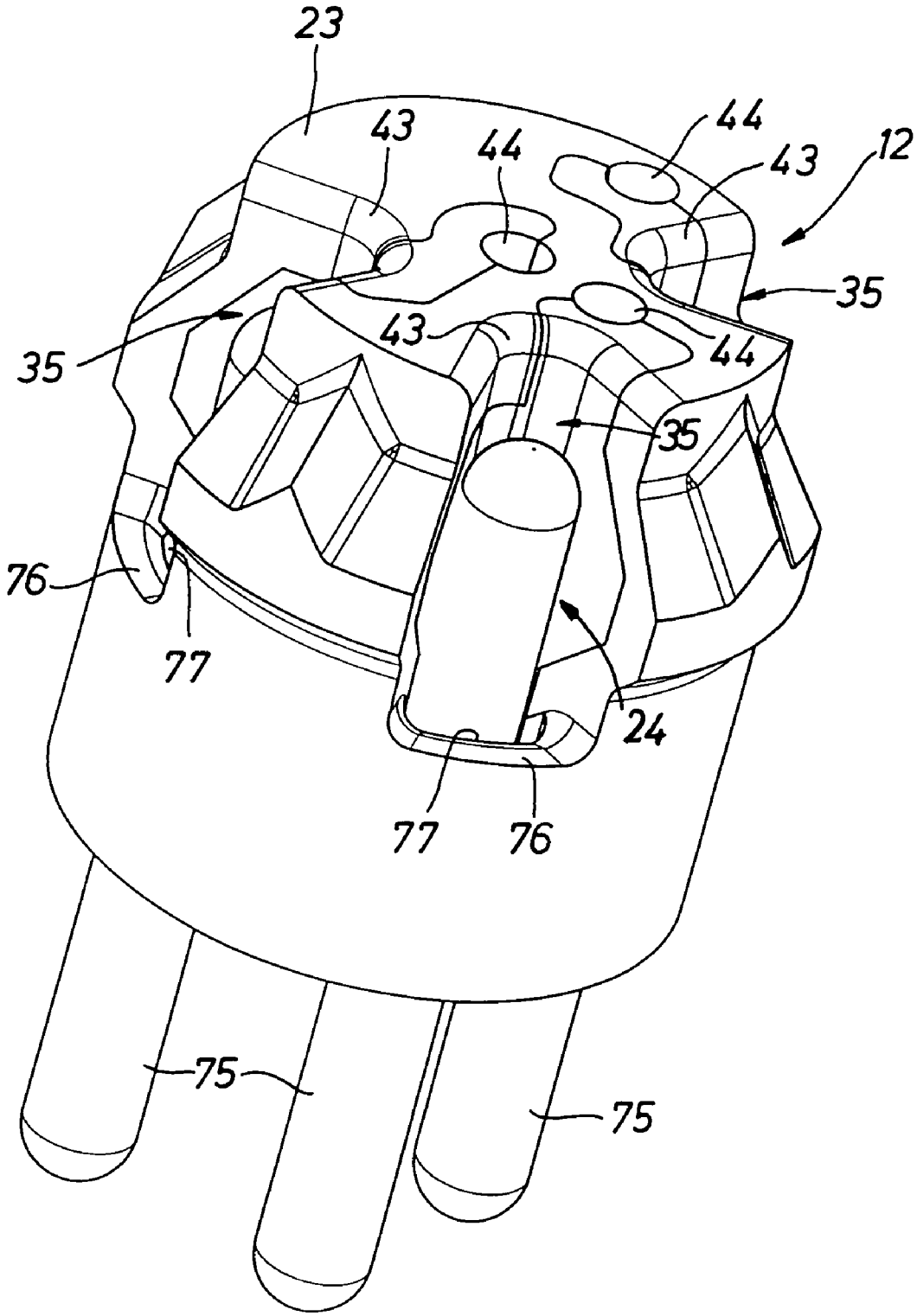

FIG. 19 is a separate view of the contact carrying drum, integrated in the design of FIG. 18, as seen in perspective.

DETAILED ACCOUNT OF WORKING EMBODIMENTS OF THE INVENTION.

Starting with the embodiment illustrated in FIGS. 1 through 11 of the electromechanical plug device a plug connector 1 is provided, which may enter into a releasable electrical and mechanical connection with a mating plug connector 2. The mating plug connector is for example a component of an electrical device, which is to be supplied with electrical signals or itself produces such electrical signals. The electrical device may be for example a sensor or an electronic control device employed in the automation art.

The mating plug connector 2 is designed in the form of a cup and has a floor 3 which is adjoined by a sleeve-like wall section 4 provided with a male screw thread 5. The floor has a plurality of second plug contacts 6 extending through and anchored in it, which are in the form of pins and which at one end make contact with the associated electrical device (not illustrated), whereas their front end regions extend axially into the space 7, delimited by the floor 3 and the sleeve-like wall section 4, of the mating plug connector 2.

The plug connector 1 is preferably in the form of an elbow plug. Inter alia it comprises an outgoing cable part 8 and a contact carrying drum 12, which is rotatably supported on the outgoing cable part 8 for rotation about its longitudinal axis 13.

The outgoing cable part 8 possesses a housing 14 manufactured of plastic material, in which a preferably plate-like circuit substrate 15 is embedded. It bears an electrical circuit, not illustrated in detail, as for example in the form of metal conductive structures with or without additional electronic components and is electrically connected with the cores 16 of an electric cable 17, whose one end is embedded in a outgoing cable part or section 18 of the housing 14 and thence leaves the plug connector 1. The cable 17 and the cores 16 are merely indicated in chained lines. The outgoing cable part 18 extends athwart the structure and is more especially at a right angle to the longitudinal axis 13.

The essentially cylindrical contact carrying drum 12 has two mutually opposite end regions, which in the following will be termed the axial front side 21 or end and the axial rear side 22 or end. The contact carrying drum 12 possesses an integral or multi-part carrying body 23 of plastic material, on which first electrical plug contacts 24 are arranged.

The first plug contacts 24 are accessible from the axial front side 21, facing away from the outgoing cable part 8, of the contact carrying drum 12 in order to render possible an electrical plugged connection with the second plug contacts 6 of the mating plug connector 2. Adjacent to the axial rear side 22 of the contact carrying drum 12 the first plug contacts 24—in the case of the working embodiment of FIGS. 1 through 11 there are three thereof—are each provided with at least one axially aligned first abutment type contact face 25 opposite which there is a respective facing second abutment type contact face 26 in the direction of the longitudinal axis 13, which are provided in a contact making region 27 of the circuit substrate 15.

While the first abutment type contact faces 25 are provided on axially resilient button contact elements 28 belonging to the first plug contacts 24 so that there are punctuate contact areas, the second abutment type contact faces 26 comprise a plurality of annular structures arranged concentrically to one another relative to the longitudinal axis 13. In accordance with the radial distance apart of such annular second abutment type contact faces 26 the first abutment type contact faces 25 are at different distances from the longitudinal axis 13. The consequence of this is that in the case of a rotation of the contact carrying drum 12 about its longitudinal axis 13 in relation to the outgoing cable part 8, the first abutment type contact faces 25 with a punctuate distribution will be moved along the circular line of the respectively opposite second abutment type contact face 26. Thus there is the possibility, owing to the making of contact in pairs of first and second abutment type contact faces 25 and 26 irrespectively of the instantaneous angular alignment of the outgoing cable part 8 in relation to the contact carrying drum 12 by producing an electrical connection between the first plug contacts 24 of the contact carrying drum 12 and the circuit, connected with the second abutment type contact faces 26, of the circuit substrate 15.

Owing to the circular shape of the second abutment type contact faces 26 non-angle-limited rotation of the outgoing cable part 8 relative to the contact carrying drum 12 is possible, the above mentioned electrical connection being possible at every angular position.

If a first abutment type contact face 25 is on the longitudinal axis 13 of the contact carrying drum 12, the associated second abutment type contact face 26, as in the working example, will not have to have an annular shape. It is then sufficient to have a plain punctuate contact face. If unlimited rotational alignment is not required, instead of annular second abutment type contact faces 26 a circular form may be selected which does not constitute a complete loop.

The free rotatability of the outgoing cable part 8 is possible until long as the plug connector 1 and the mating plug connector 2 are braced together axially, that is to say in the direction of the longitudinal axis 13. This bracing or clamping is caused by a sleeve-like attachment nut 32, which is permanently tethered on the housing 14 of the outgoing cable part 8 in a manner allowing rotation and axial shift, it surrounding the contact carrying drum 12 coaxially and with a radial clearance. On its inner periphery it is provided with an inner screw thread 33 complementary to the outer screw thread 5.

In order to produce the desired electrical connection the plug connector 1 is inserted, with the axial front side of the contact carrying drum 12 to the fore, into the inner space of the mating plug connector 2, the first and the second plug contacts 24 and 6 cooperating to produce a plugged connection with each other. In this state the outgoing cable part 8 is still rotatable in relation to the contact carrying drum 12, which for its part, owing to the said plugging engagement, is locked as regards rotation in relation to the mating plug connector 2.

After the outgoing cable part 8 has been brought into the desired angular position, the attachment nut 32 is screwed onto the sleeve-like wall section of the mating plug connector 2 and drawn tight. This means that the axial depth of plugging applying for the first and second plug contacts 24 and 6 will be still further increased and simultaneously the mating plug connector 2 will be shifted in the direction of the longitudinal axis 13 against the housing 14 of the outgoing cable part 8, it thrusting the contact carrying drum 12 against the circuit substrate 15 so that the first and the second abutment type contact faces 25 and 26 are firmly braced together. Accordingly the set angular position is held in a releasable manner.

Figure 1:
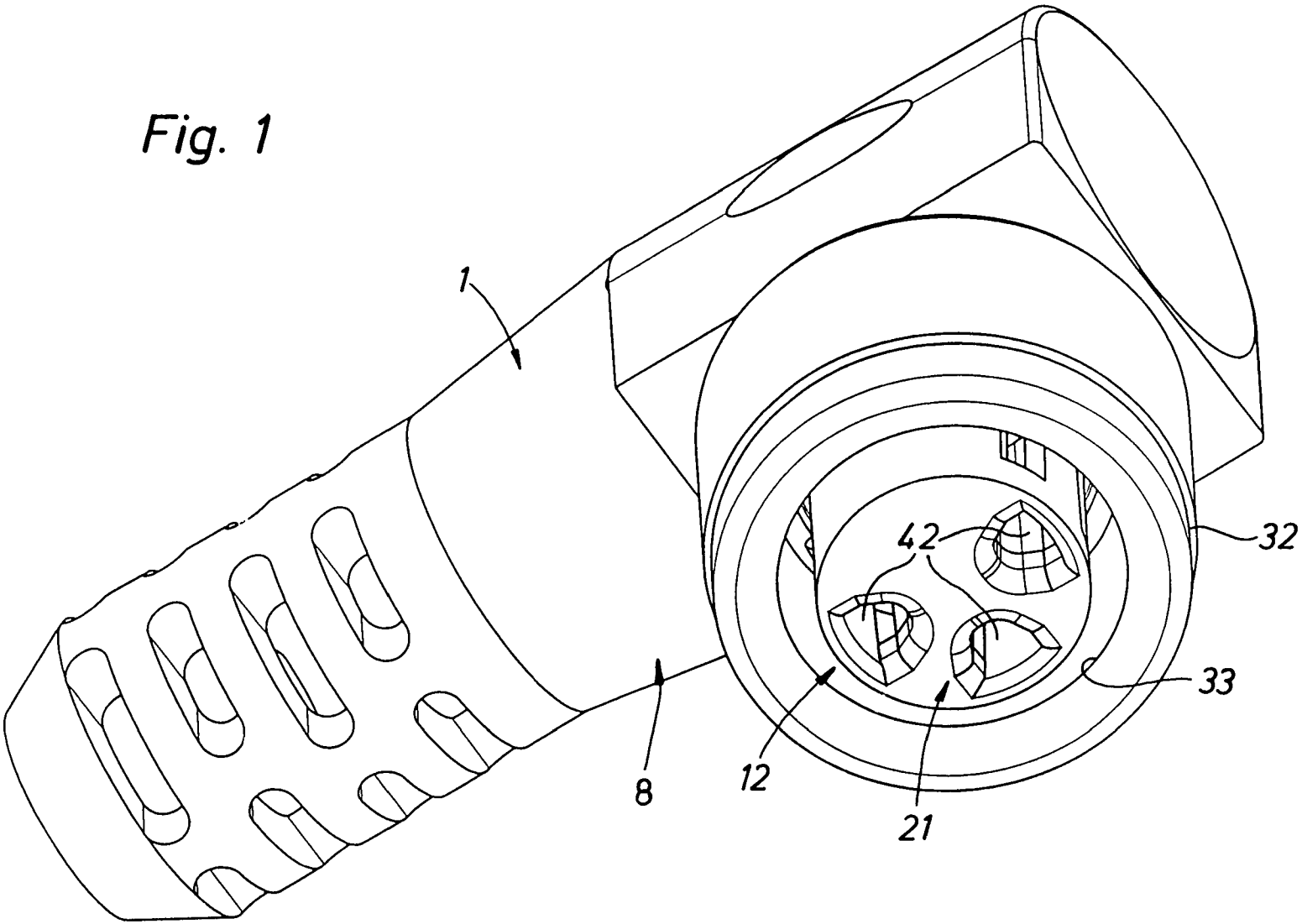
FIG. 1 shows a first design of a plug connector, in the form of an elbow plug, of the plug device in accordance with the invention in a perspective representation looking obliquely upward.
Figure 2:
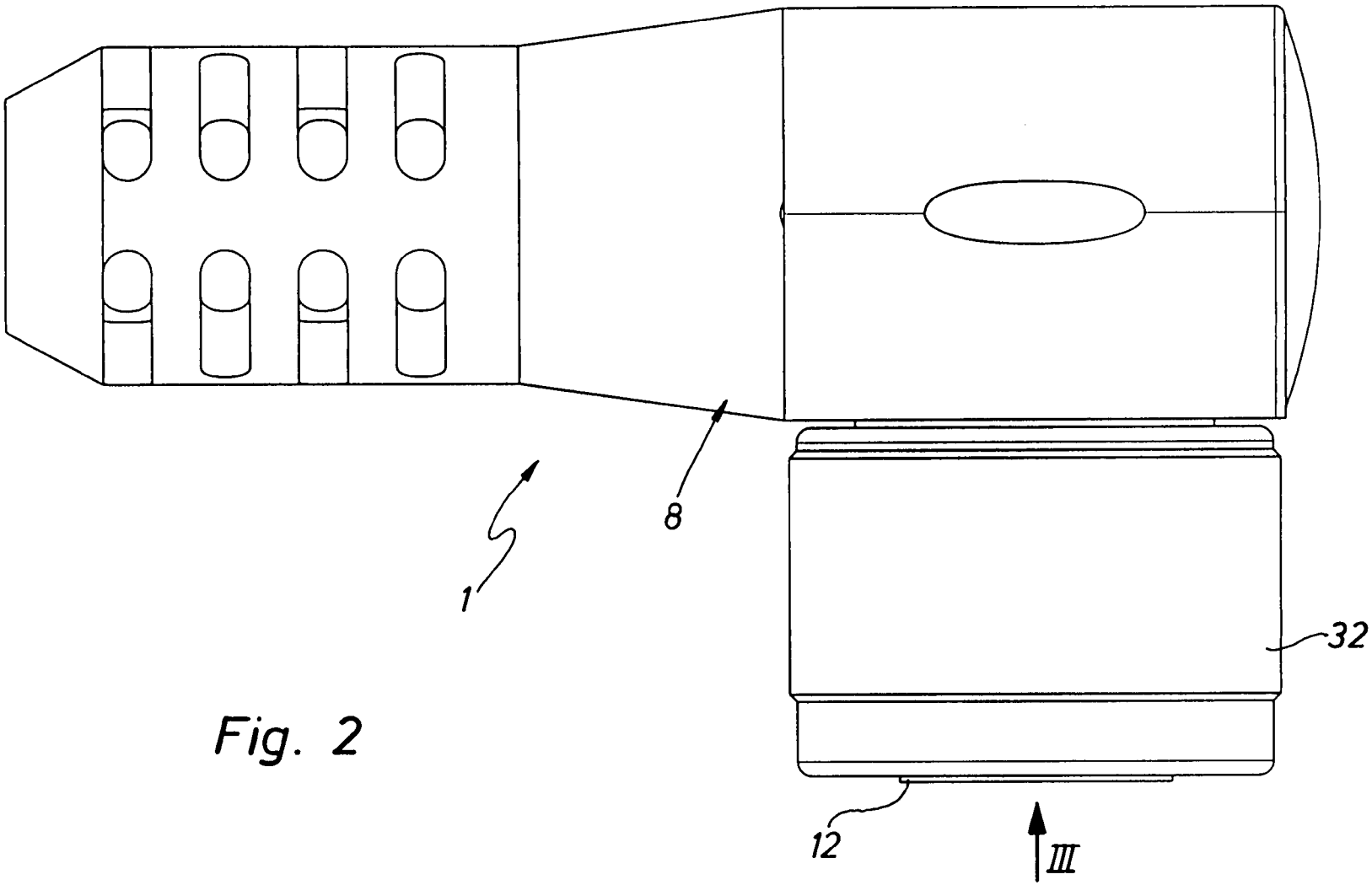
FIG. 2 shows the plug connector of FIG. 1 in a lateral elevation.
Figure 3:
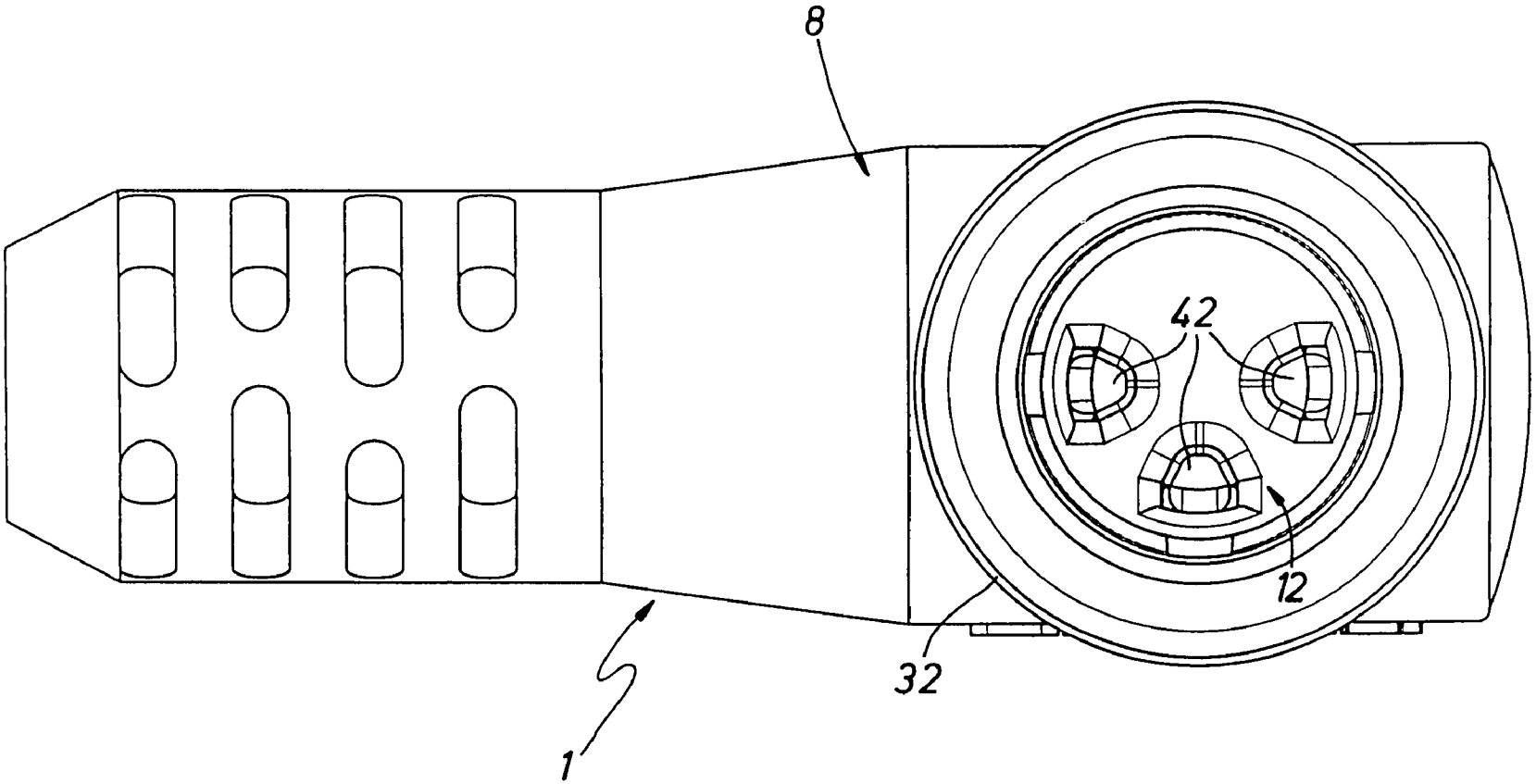
FIG. 3 is a view from below of the plug connector of FIGS. 1 and 2 looking in the direction of arrow III of FIG. 2.
Figure 4:
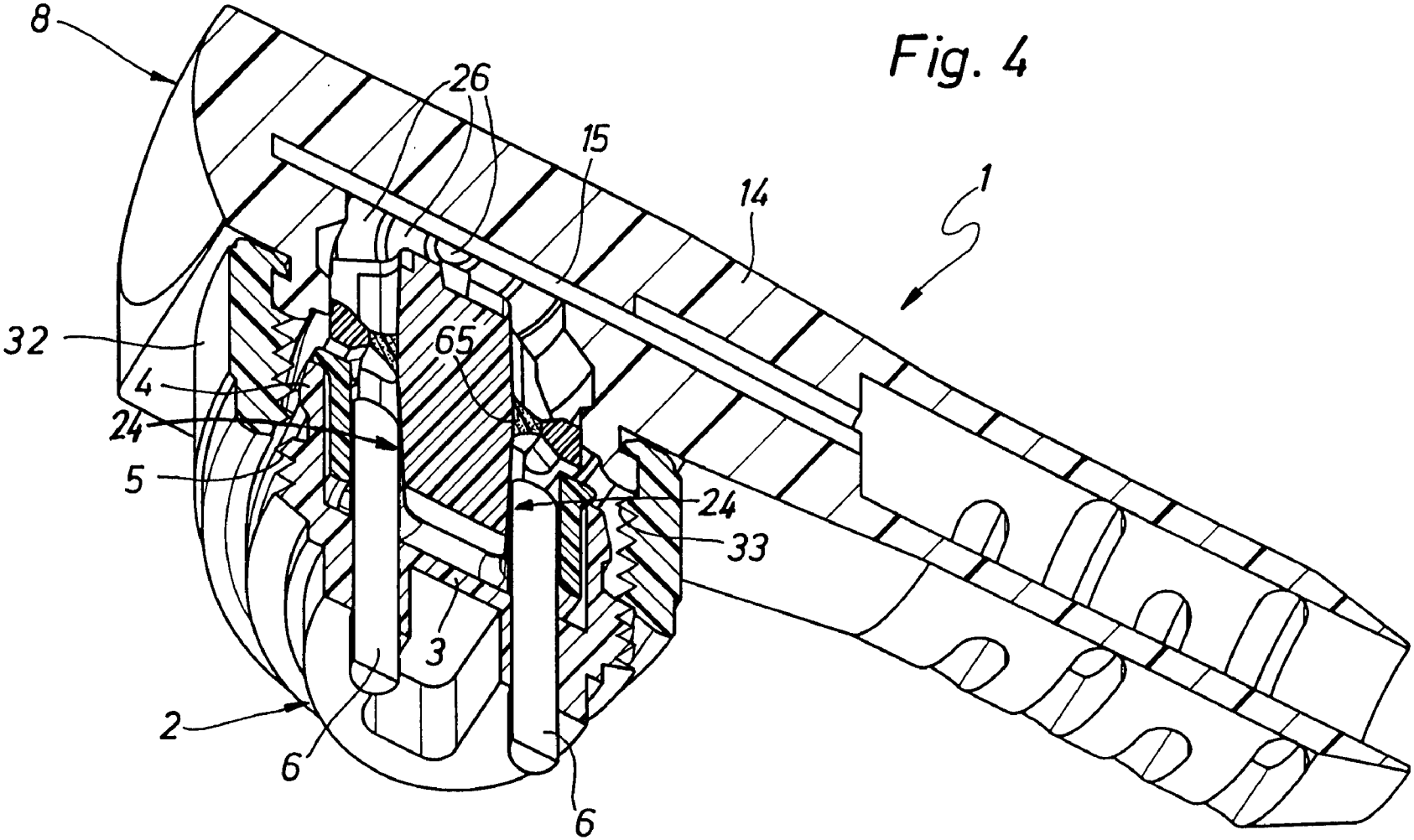
FIG. 4 shows in a perspective representation a longitudinal section taken through the plug device with a plug connector fitted on a mating plug connector prior to tightening up and the axial clamping action on the plug connector and the mating plug connector.
Figure 5:
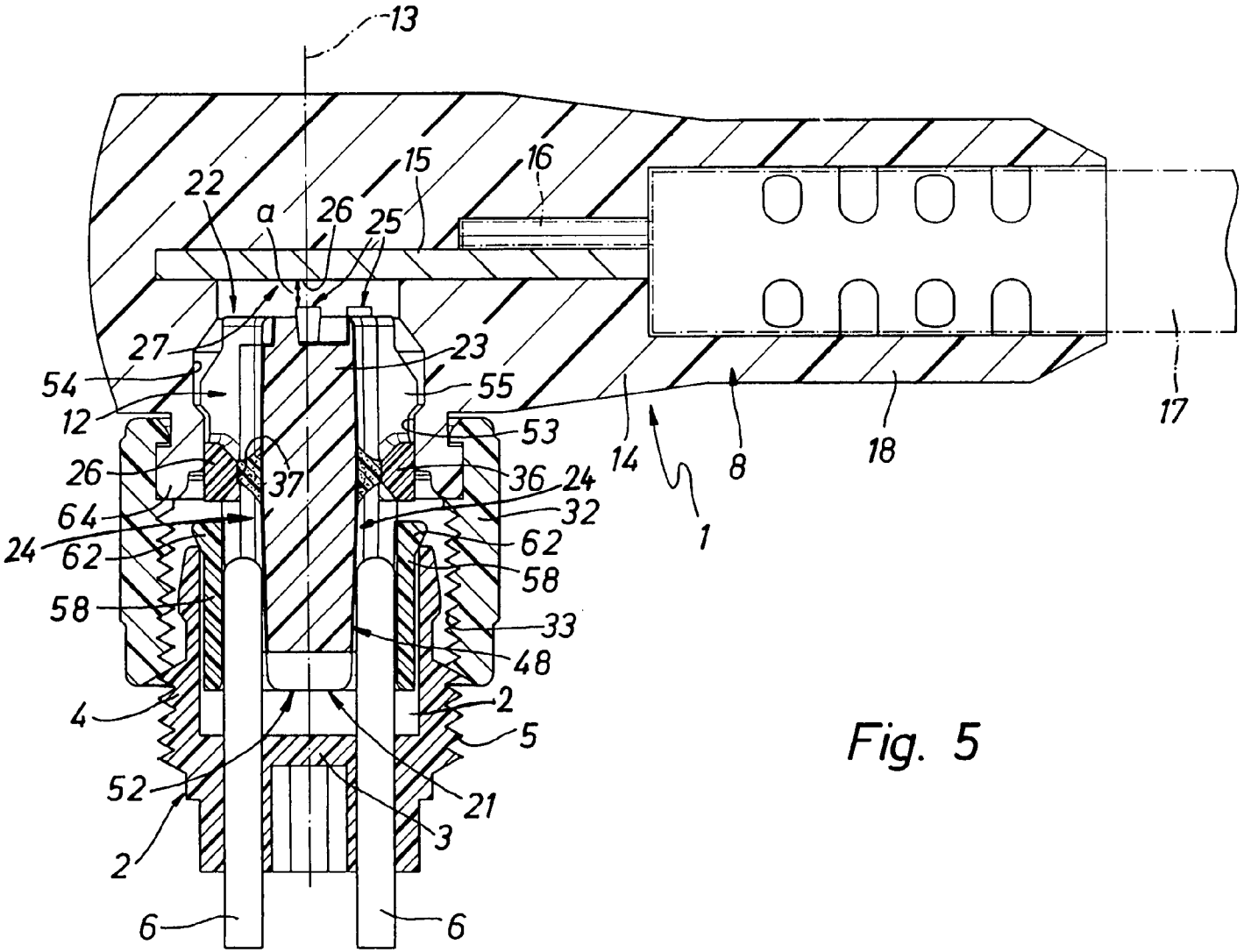
FIG. 5 shows the arrangement of FIG. 4 in a bidimensional sectional representation.
Figure 6:
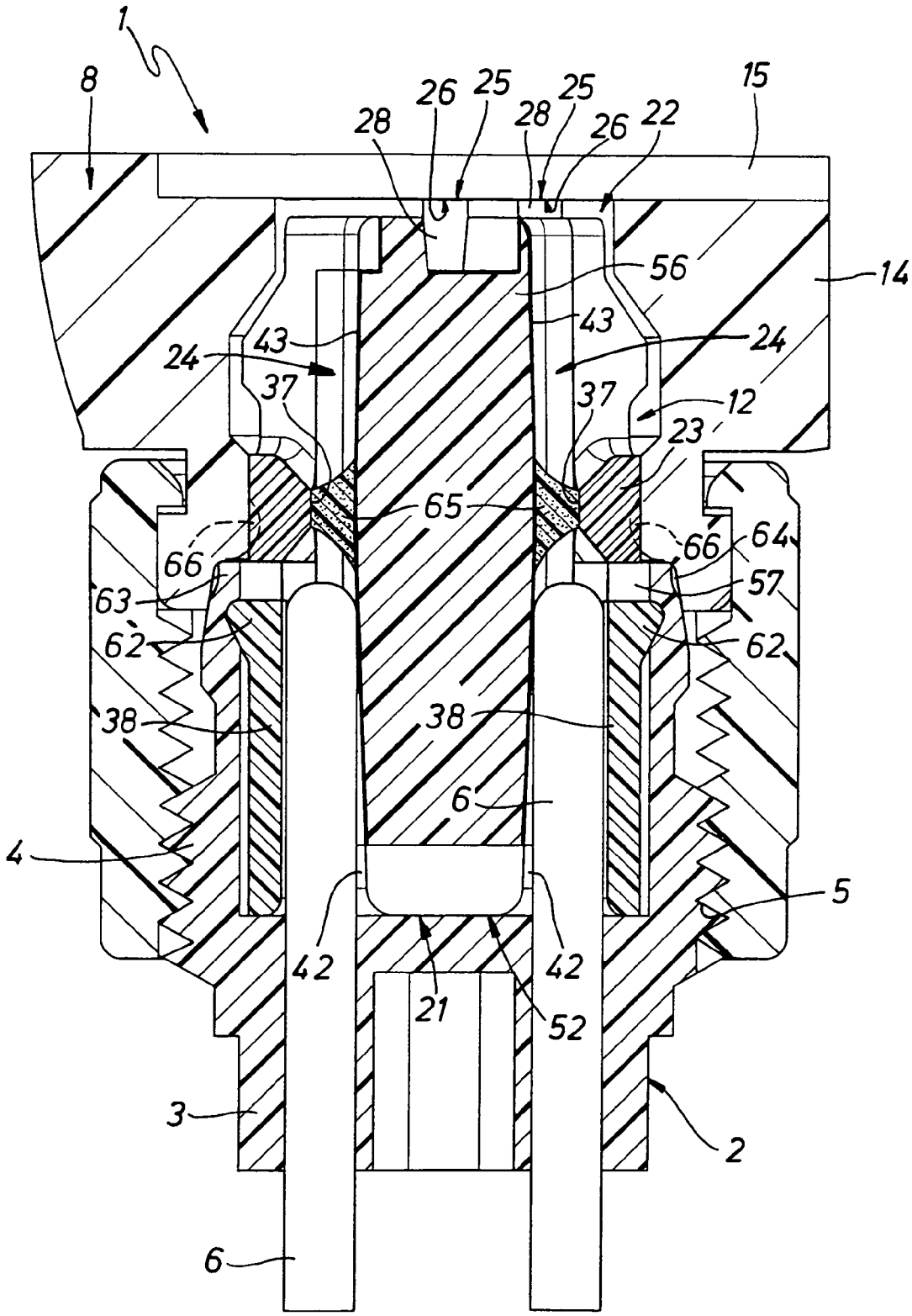
FIG. 6 is a view on a larger scale of the contact area between the plug connector and the mating plug connector as in the arrangement of FIGS. 4 and 5, the mechanical connection being drawn tight so that the plug connector and the mating plug connector are axially braced.
Figure 7:
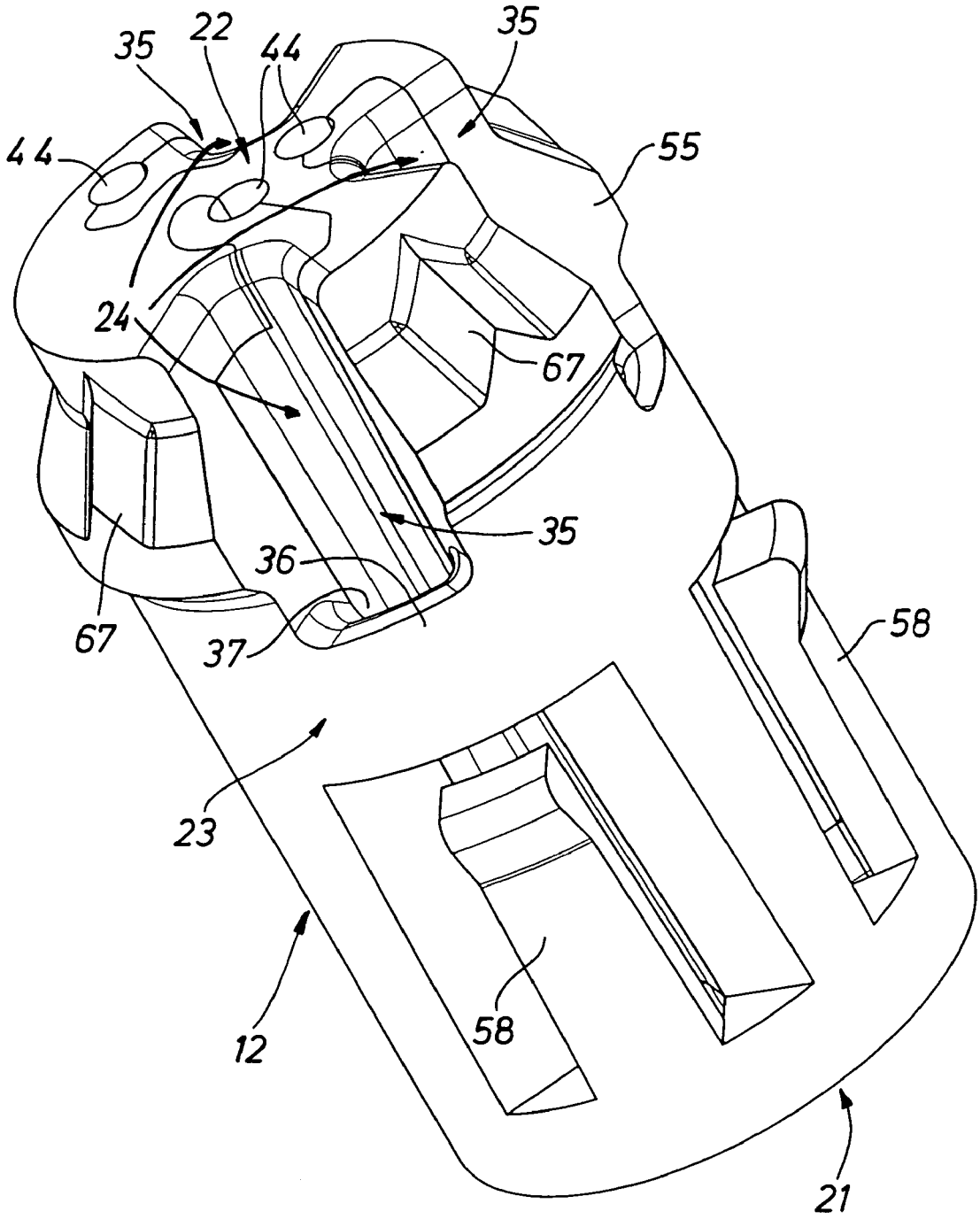
FIG. 7 is a separate representation of the contact carrying drum, present in the FIGS. 1 through 6, such drum being in the form of a dual component MID injection molding, as seen in a view looking obliquely from above onto the axial rear side.
Figure 8:
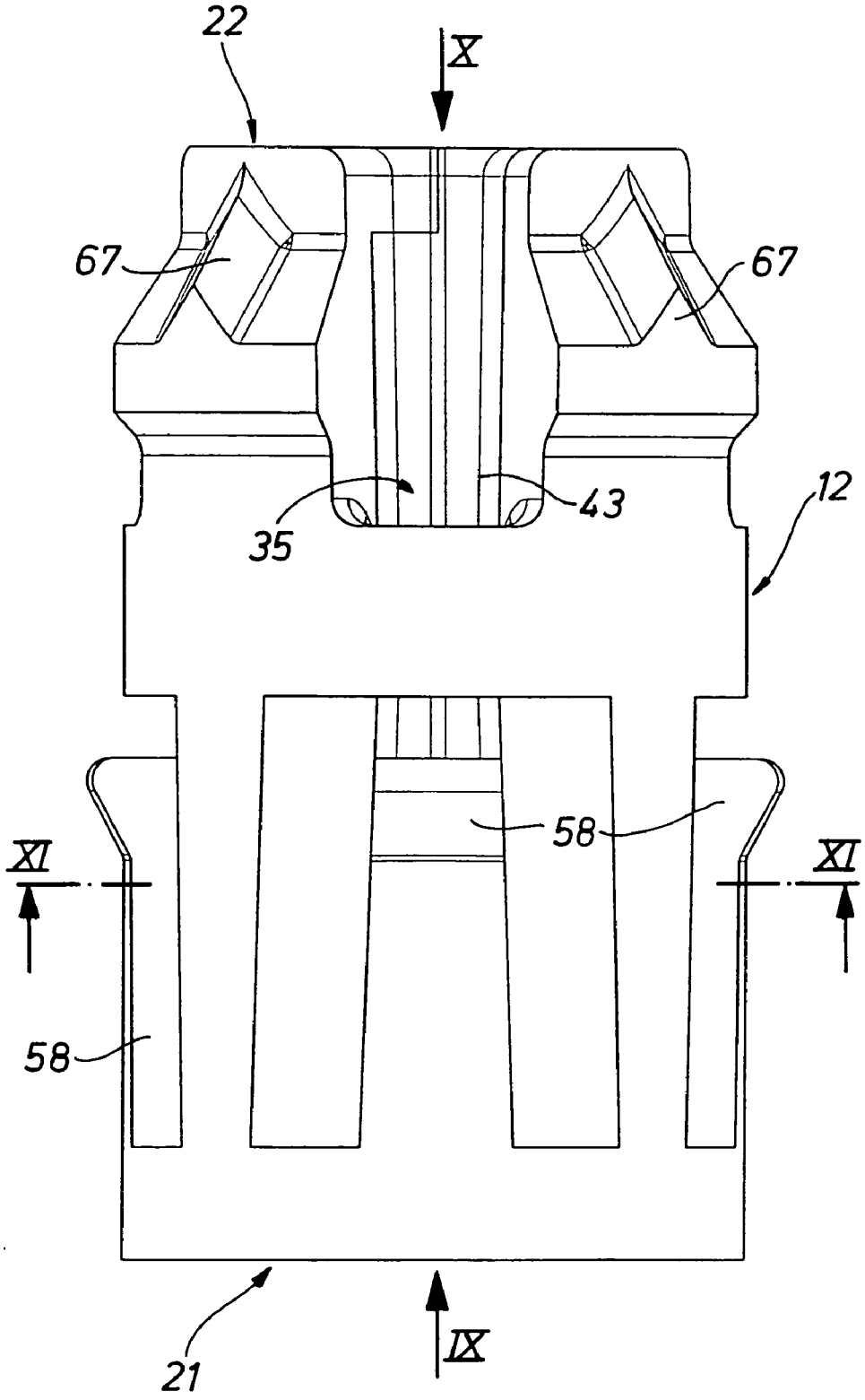
FIG. 8 is a side view of the contact carrying drum depicted in FIG. 7.
Figure 9:
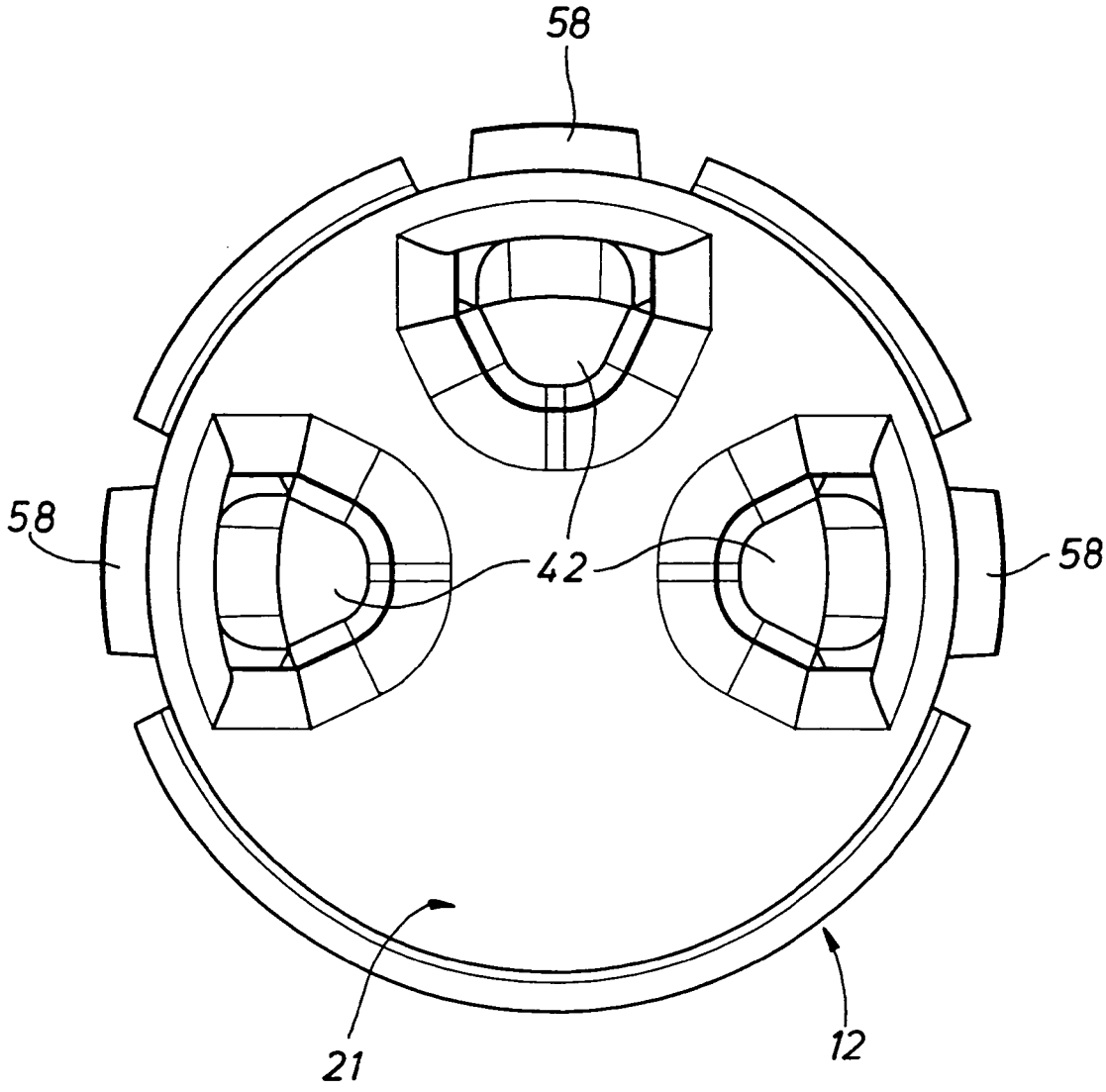
FIG. 9 is a view from below of the contact carrying drum looking in the direction of the arrow IX in FIG. 8 directed toward the axial front side.
Figure 10:
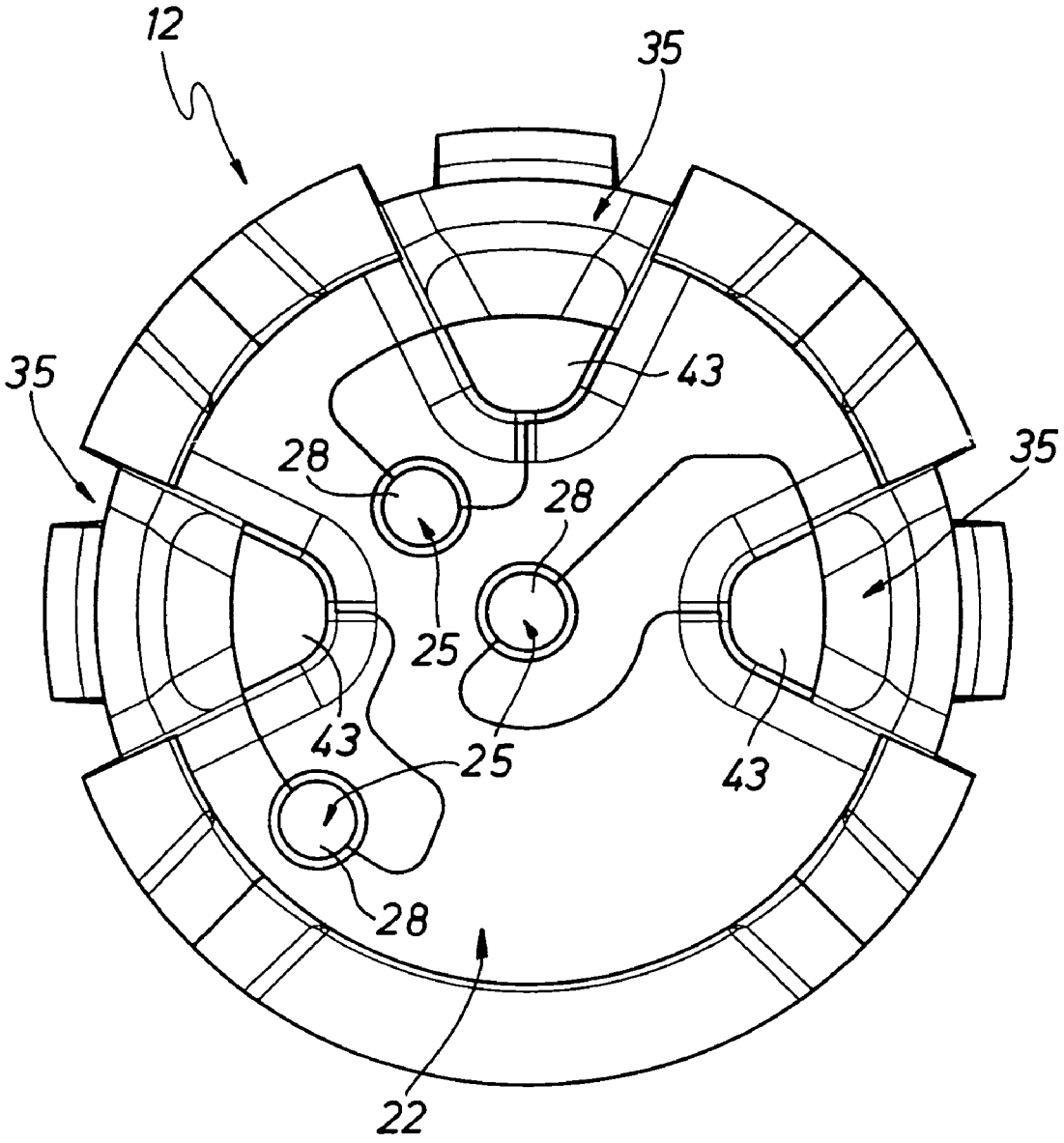
FIG. 10 is a plan view of the contact carrying drum as in FIGS. 7 through 9 looking in the direction of the arrow X of FIG. 8 directed toward the axial rear side.

While FIGS. 4 and 5 show the simply assembled thrusting together by the attachment nut 32, FIG. 6 indicates the condition after tightening of the attachment nut 32 so that the electrical connection is reliably produced and the set angular position is held.

Figure 12:
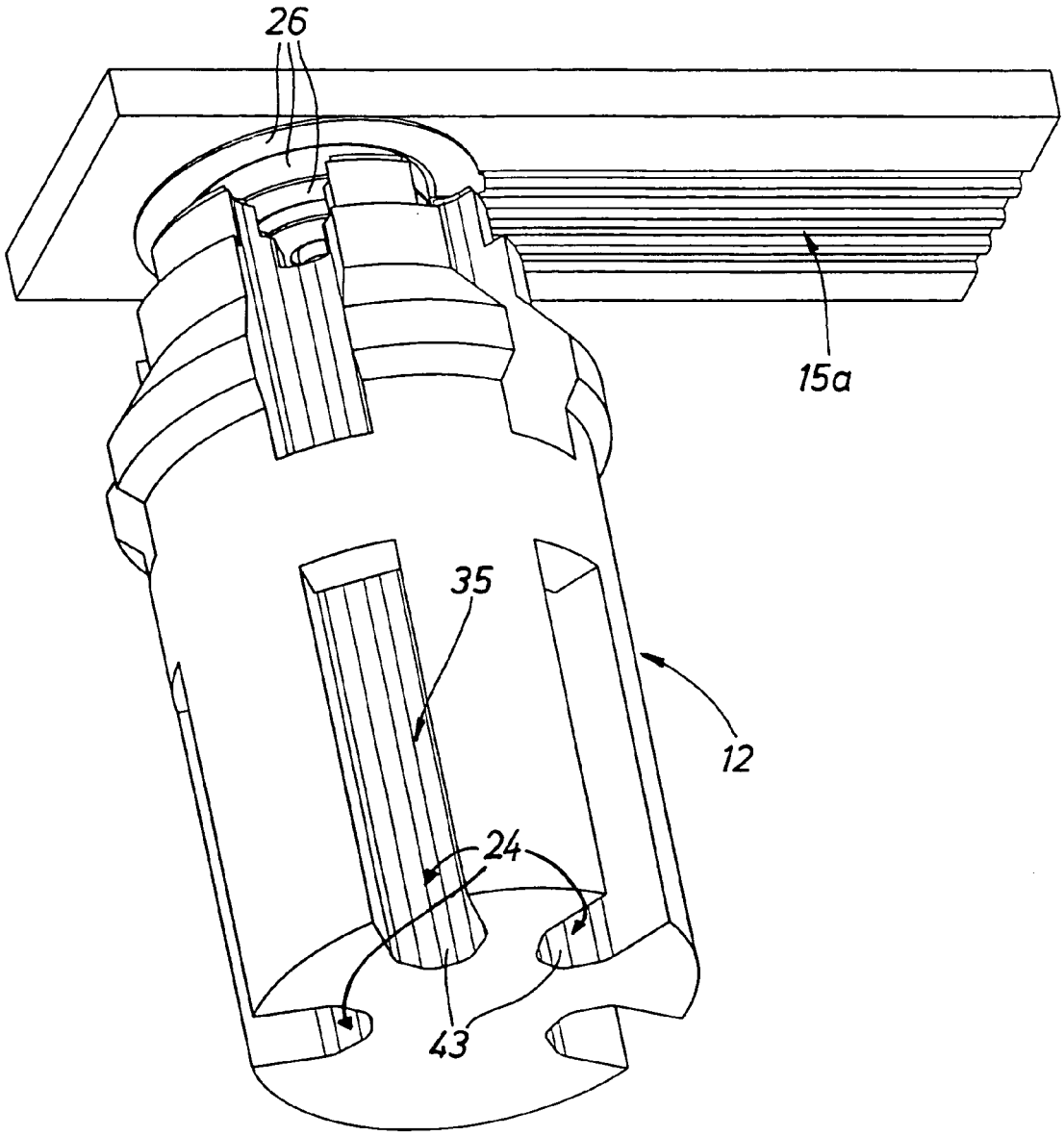
FIG. 12 shows a modification of the electromechanical plug device, only the circuit substrate and the contact carrying drum of the plug connector being illustrated and the circuit substrate being in the form of a 3D-MID component.
Figure 13:
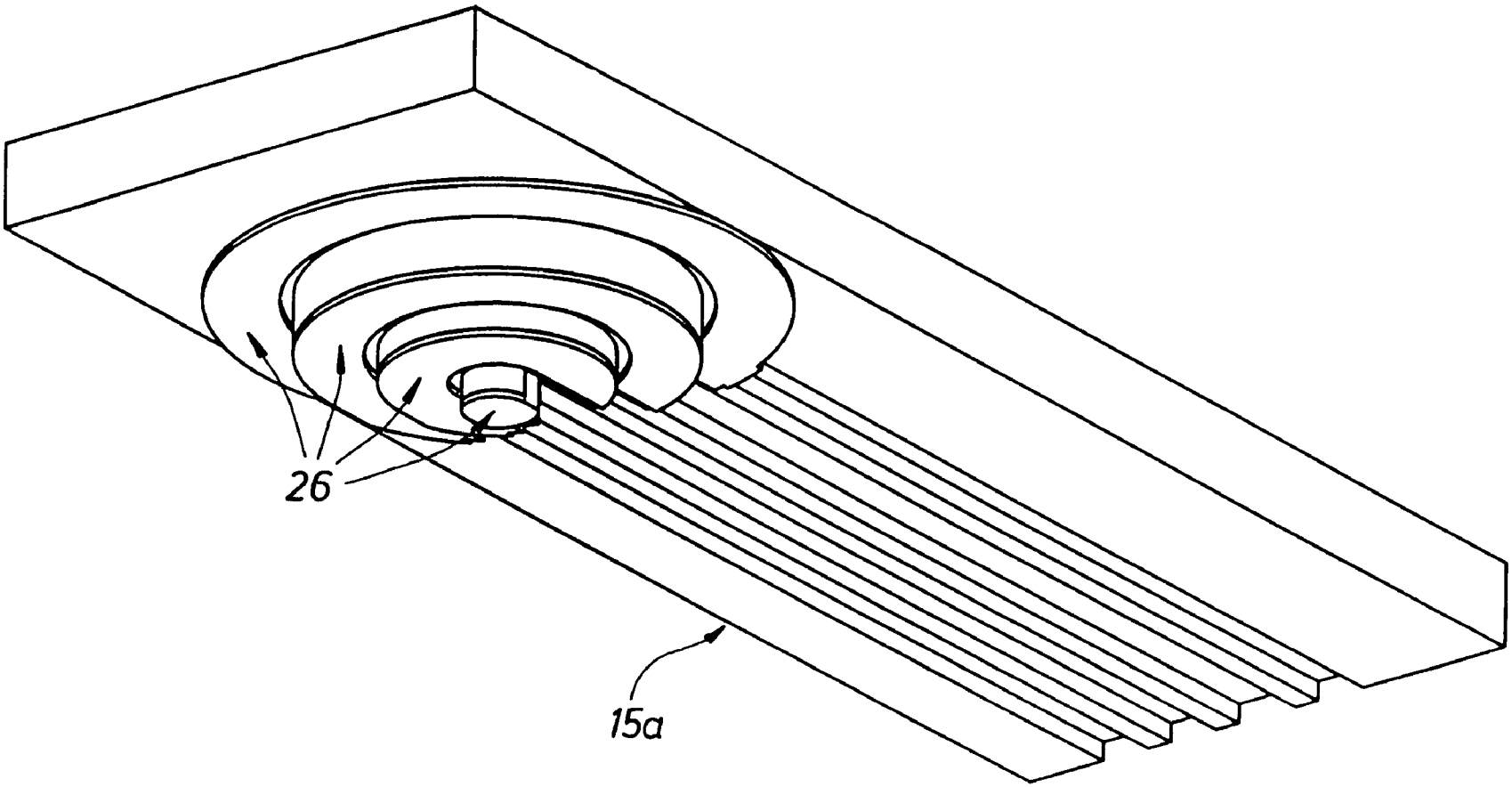
FIG. 13 is separate view of the 3D-MID circuit substrate as in FIG. 12 in a perspective elevation looking obliquely upward.
Figure 14:
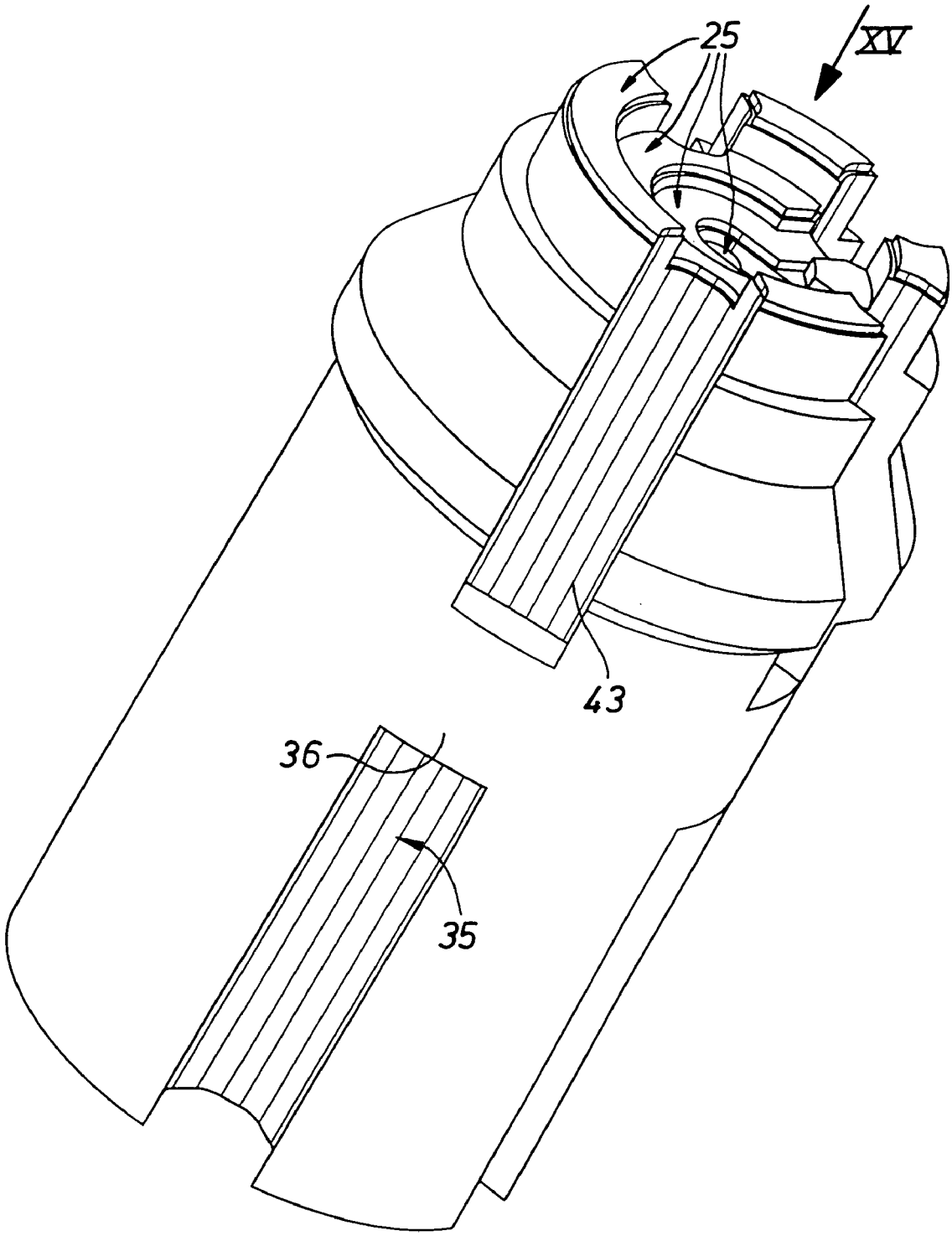
FIG. 14 shows the contact carrying drum employed in FIG. 12 in a perspective separate view.
Figure 15:
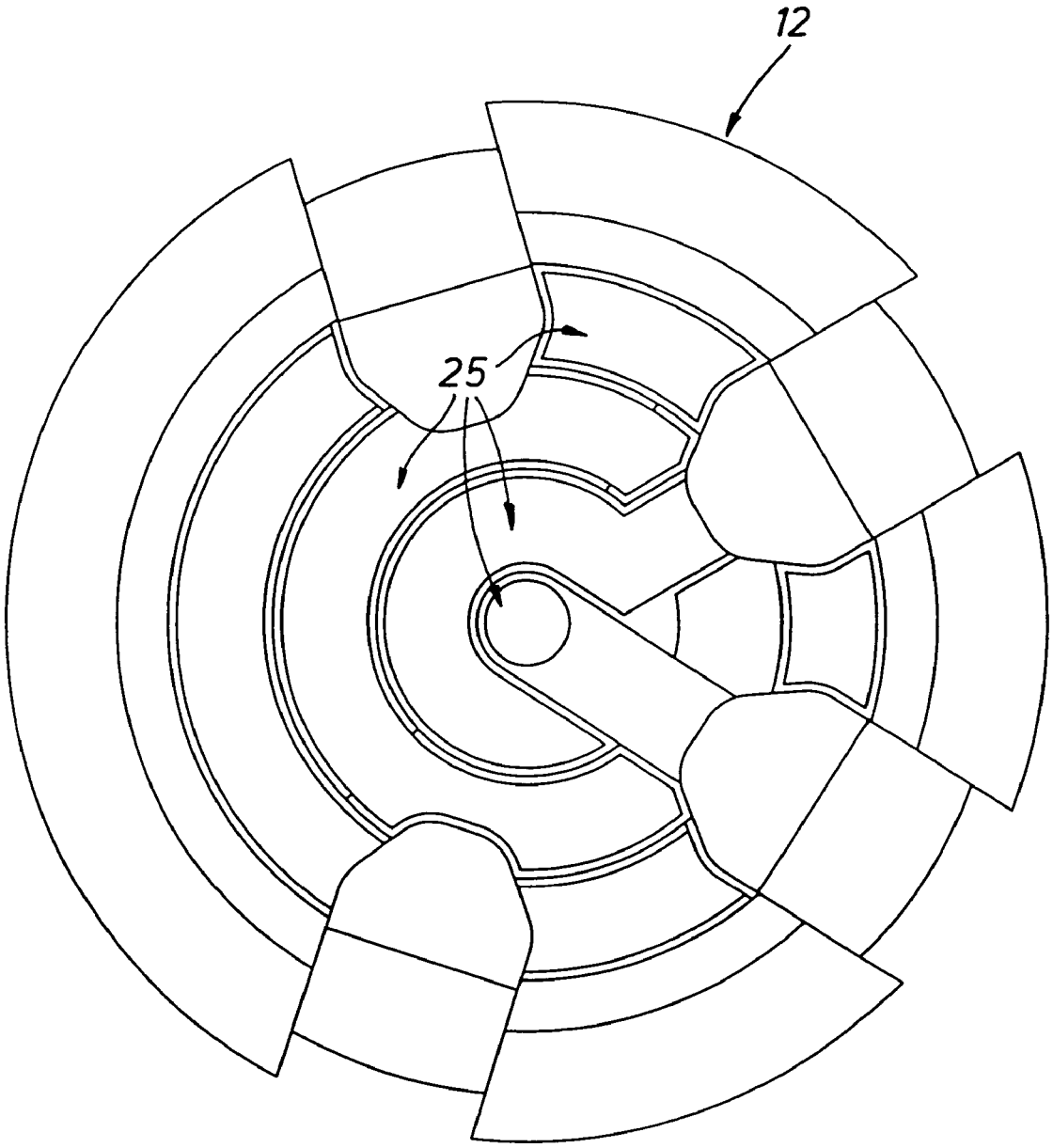
FIG. 15 is a view from above of the contact carrying drum of FIG. 14 looking in the direction of the arrow XV as seen looking toward the axial rear side.

The circuit substrate 15 of the design in accordance with FIGS. 1 through 11 is a circuit board. However, it is possible to have a design in the form of a preferably also board-like, 3D-MID support structure, as is the case with the circuit substrate 15 of the working embodiment in accordance with FIGS. 12 and 13. For production thereof the circuit substrate is provided with components and electrical conductors as required and in this condition is injection potted with plastic material to constitute the housing 14. The housing material is preferably a soft, translucent material, which as regards the actual requirements is optimized prevent kinking or bending and to provide a sealing action.

If a 3D-MID circuit substrate is employed, which instead of the contact carrying drum 12 is fitted with button contact elements 28, it is for example provided with the desired layout, for example by means of laser machining or hot embossing. Accordingly using a plain molded substrate a series of modifications of plug devices may be economically made and customized to meet existing applications.

In the case of the design of FIGS. 1 through 11 the contact carrying drum 12 is a structure made from two components by molding and which using MID technology is partly metallically coated in order at least to produce the essential components of the first plug contacts 24.

As regards details, the carrying body 23 comprises a plurality of groove-like recesses 35 arranged distributed along the periphery, which each extend through from the front side 21, at some points, such recesses being covered over radially. A first covered over region is due to such groove-like recesses 35 at the same level—being bridged over by first rib sections 36 of the carrying body 23 so that axially continuous window-like openings 37 are produced.

A further covered over portion of the groove-like recesses 35 is due to second rib sections 38 of the carrying body 23, which are located at the axial front side 21 of the contact carrying drum 12. They delimit channel-like sockets 42 along a part of their length into which the pin-like second plug contacts 6 may be plugged, such sockets 42 being open toward the axial front side 21.

Figure 11:
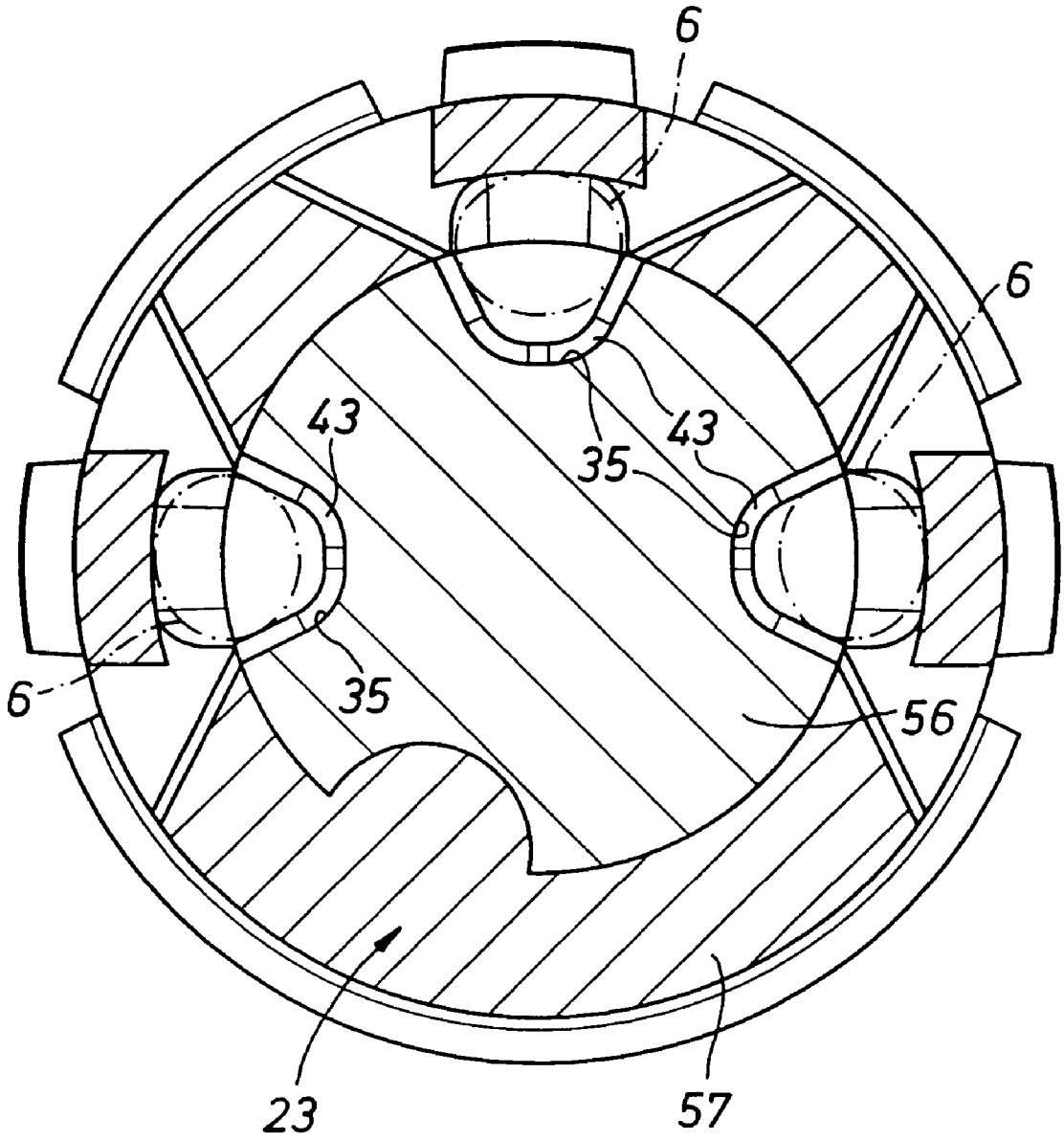
FIG. 11 is a cross section taken through the contact carrying drum of FIGS. 7 through 10 taken on the section line XI—XI of FIG. 8.

The groove-like recesses 35 are peripherally coated with metal, the metal layers constituting first electrical conductors 43, which are components of the first plug contacts 24. Preferably, the groove-like recesses 35—as is indicated in FIG. 11—have a trapezoidal cross section, both their base area and also their flanks converging toward the base area being metallically coated to form the initially mentioned first electrical conductor 43.

On the axial rear side 22 the first electrical conductors 43 emerge from the groove-like recesses 35 and extend toward receiving recesses 44 provided at the end in the carrying body 26, in which recesses the above mentioned resilient button contact elements 28 are firmly placed with the production of an electrically conductive connection with the first electrical conductors 43.

The button contact elements 28 may consist of a continuous molybdenum spring wire, which has been pressed into a cylindrical form and possesses resilient properties. Thus an extremely high level of contact reliability is achieved. If required the button contact element 28 may be supplemented by having a contact plunger or replaced by a spring-plunger unit. It would also be feasible to employ a permanently elastic contact material instead of the button contact elements 28, which contact material is dispensed into the receiving recesses 44 in the carrying body 23 so that fixing of the contacts by using conductive adhesive is unnecessary.

In order to further increase contact reliability instead of button contact elements 28 conductive dot and/or ring structures of the above mentioned permanently elastic contact material—as for example an electrically conductive sealant or conductive adhesive—may find application. The contact material may be directly applied to the first electrical conductor 43. Furthermore, it is possible to provide vias filled with the contact material on the corresponding first electrical conductor of the contact carrying drum 12.

Figure 16:
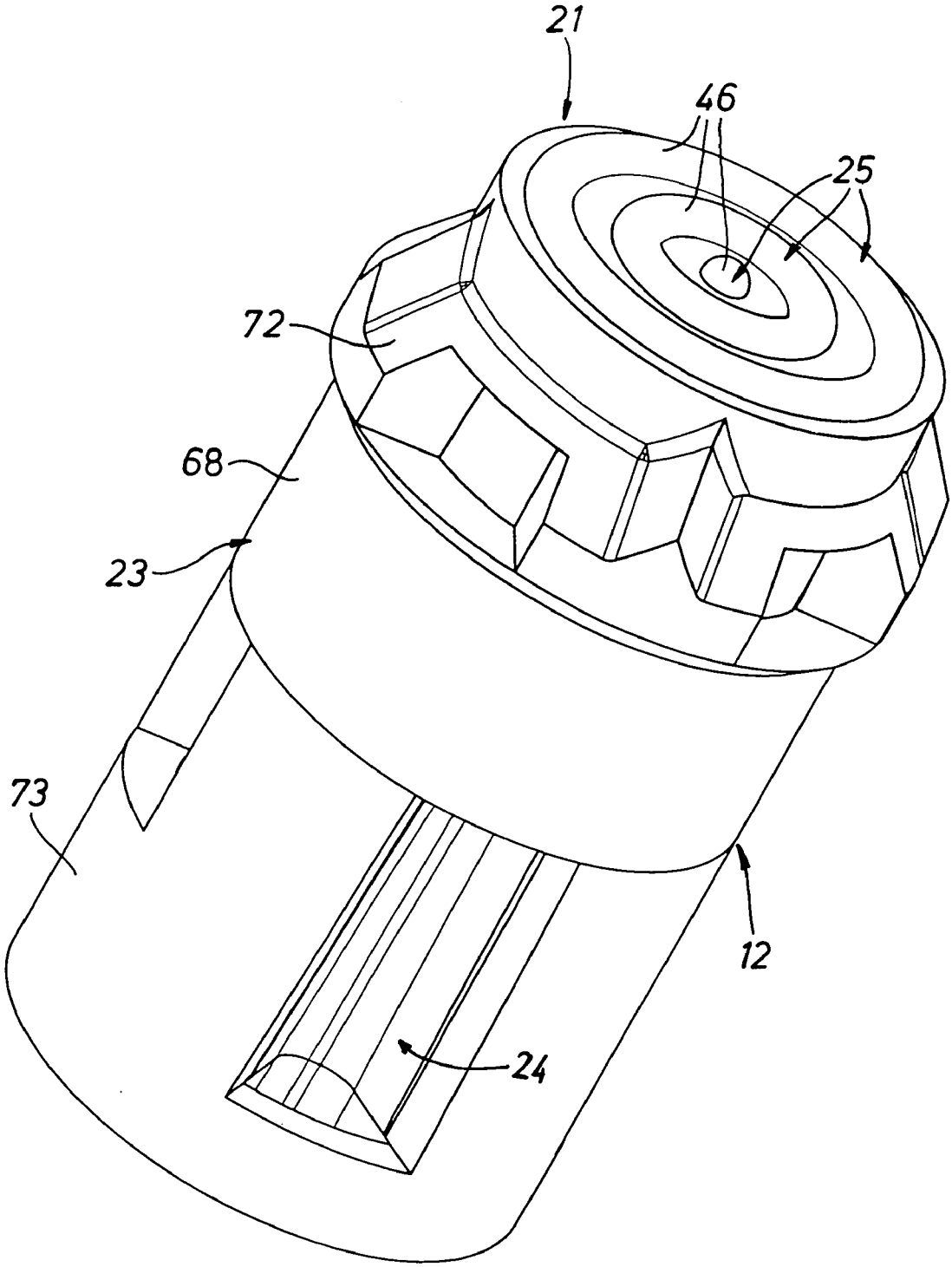
FIG. 16 shows a further possible design of the contact carrying drum in a perspective separate view, the first abutment type contact faces being annularly designed and consisting of a permanently elastic contact material.
Figure 17:
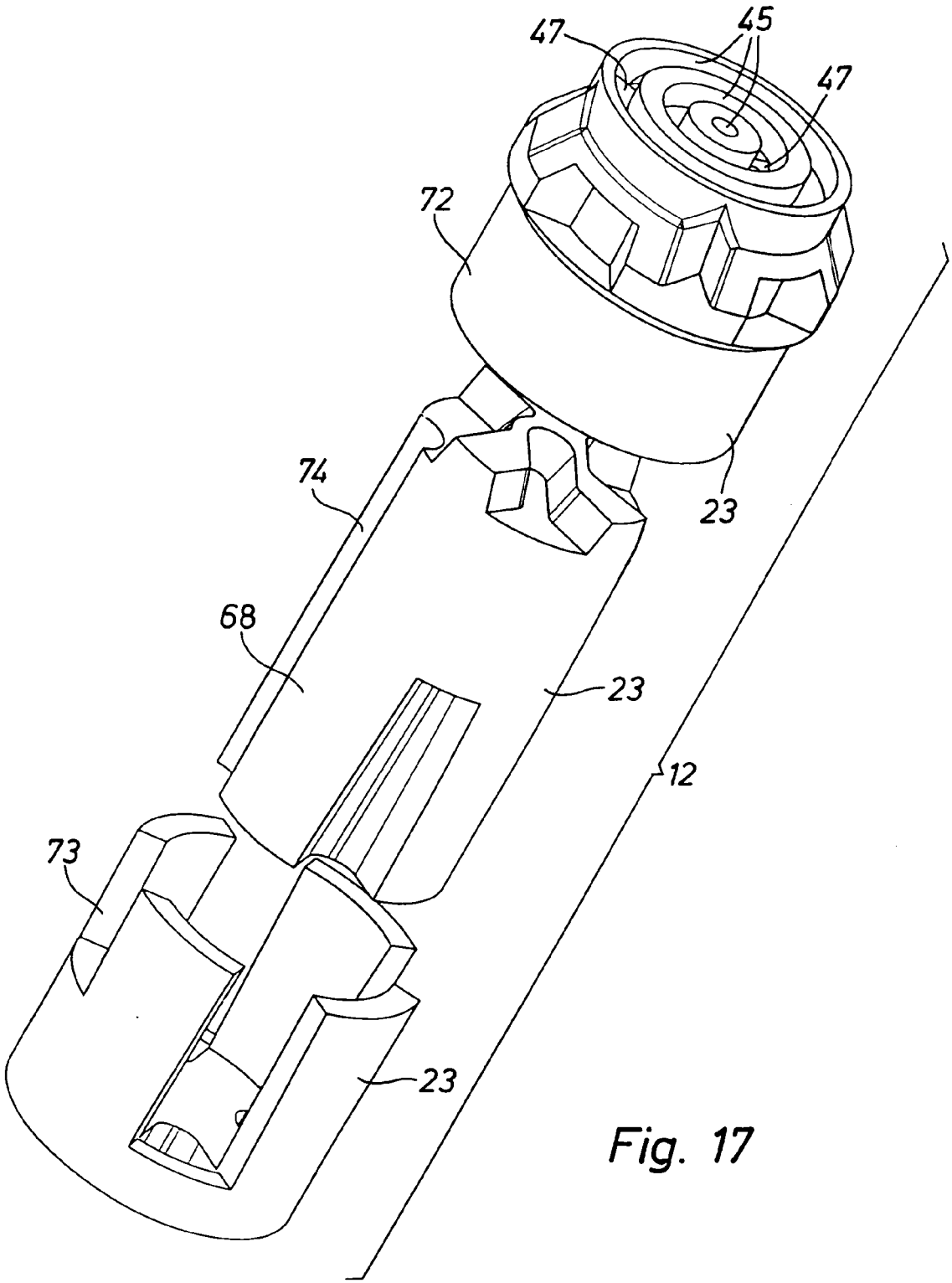
FIG. 17 shows the contact carrying drum to indicate a preferred multi-component structure with a central core and two head parts put in place from two opposite ends.

The last mentioned concept is employed in the case of the design illustrated in FIGS. 16 and 17. Here contact material 46 is present at the axial front side 21 in corresponding recesses 45 in the carrying body 23 and furthermore vias generally indicated at 47.

As an alternative to dispensing it is also possible for prefabricated rings and balls or cylinders of conductive material, as for example O-rings, to be installed to constitute the first abutment type contact faces 25.

The above description will apply in like manner for the second abutment type contact faces 26 if same are to be correspondingly designed.

If the plug device possesses a large number of poles in relation to the diameter, for example in the case of a four pole M8 design, it is more particularly to be recommended to use an MID circuit substrate, since in this case the necessary signal transmission separated in space is possible with respect to the contact carrying drum 12. This will be clear in the design depicted in FIGS. 12 through 15, in which the second abutment type contact faces 26 extend at different levels 26 in the direction of the longitudinal axis 13. A corresponding split in level then results in the case of first abutment type contact faces 25 of the contact carrying drum 12.

In principle it would be possible to so design the plug device that the outgoing cable part 8 would remain rotationally mobile even when the attachment nut 32 is tightened, in relation to the contact carrying drum 12. This would however lead to a certain wear problems owing to the first and second abutment type contact faces 25 and 26 sliding on one another. Accordingly the design already indicated is considered to be in which the outgoing cable part is immobilized by tightening the attachment nut, which is more especially a knurled nut.

In this connection the contact carrying drum 12 is able to be moved to a limited extent, i.e. by the amount "a" indicated in FIG. 5 along the longitudinal axis 13 in relation to the outgoing cable part 8.

In the unmounted state the contact carrying drum 12 may thus assume the initial position be moved through a distance indicated in FIG. 5 as "a" axially away from the circuit substrate 15. In this position the first and the second abutment type contact faces 25 and 26 are moved apart by the distance "a" as mentioned.

During the installation of the plug connector 1 the pin-like second plug contacts 6 enter the channel-like plug sockets 42, same fitting through and underneath the second rib sections 38 and come laterally into contact with the first electrical conductors 43. Even owing to the friction caused thereby the contact carrying drum 12 is entrained as well and shifted toward the circuit substrate 15.

This entraining effect is aided in the working example furthermore because the plug sockets 42 taper toward the axial rear side 22 of the contact carrying drum 12 in cross section so that the pin-like second plug contacts 6 are thrust toward the first electrical conductors 43 cladding the groove-like recesses 35. The tapering cross section is in the working example due to the depth of the groove-like recesses 35 decreasing axially toward the circuit substrate 15, as is illustrated in FIG. 5 at 48.

If the attachment nut 32 is screwed onto the mating plug connector 2 so that the outgoing cable part 8 is drawn toward the mating plug connector 2, after reaching a certain depth of screwing in, the floor 3 of the mating plug connector 2 will press against the front end face 52 of the carrying body 23 so that same will be firmly braced against the circuit substrate 15 (FIG. 6).

The contact carrying drum 12 is for instance endowed with the axial play "a" by insertion of the contact carrying drum 12, with its axially rear 22 to the fore, in a rotatable manner and axially tethered in a drum socket 53, constituted by a recess in the housing 14 of the outgoing cable part 8, same leading to contact making region 27 (having the second abutment type contact faces 26) of the circuit substrate 15. The drum socket 53 possesses a surrounding peripheral radial recess 54, into which one or more radially outwardly holding projections 55 on the contact carrying drum 12 fit, whose axial dimensions are smaller than those of the radial recess 54. Owing to the resulting interlocking effect the contact carrying drum 12 is prevented from dropping out. Simultaneously the difference in length provides the desired adjustability by the amount "a".

In principle it would be possible to manufacture the first plug contacts 24 as metallic sleeves or using stamping and bending technology. The two component injection molding technique and MID technology employed in the working example does however possess advantages from the point of view of manufacturing techniques. Thus, the metallized layers constituting the first electrical conductors 43 may be so formed in an extremely simple manner that always at least two and in the ideal case however three, predetermined contact faces are produced on introduction of the more particularly cylindrical pin-like second plug contacts 6 in the trapezium-like groove recesses 35.

For the manufacture of the contact carrying drum 12 it is firstly possible to inject as the first component in the form of plastic material the central part of the carrying body 23 extending from the rear side 22 generally as far as the front side 21, in which the groove-like recesses 35 are formed, such recesses being provided with a metallized layer by MID technology to produce the first electrical conductors 43. A sleeve-like outer part 57 is molded on the outer periphery of the component produced in this manner as the second component of the carrying body 23, the groove-like recesses 35 remaining free. Only the above mentioned bridges across the groove-like recesses 35 are produced through first and second rib sections 36 and 38 belonging to the outer part 57.

Furthermore the outer part 57 preferably constitutes tongue-like, resiliently elastic holding elements 58, which extend over the groove-like recesses 35 at the channel-like plug sockets 42 adjoining the second rib sections 38 on the open side. These holding elements 58 are able to be elastically deformed in a direction which is radial in relation to the longitudinal axis 13 and spring back after deformation.

On insertion of the mating plug connector 2 the holding elements 58 are surrounded radially outside by the sleeve-like wall section 4 of the mating plug connector 2. As long as the attachment nut 32 is not tightened up the holding elements will exert no or hardly any thrust force on the pin-like second plug contacts 6 athwart the longitudinal axis 13. Accordingly, electrical contact is made in a manner such that the metallized layers are not damaged.

If now the attachment nut 32 is drawn tight, the sleeve-like or, respectively, the collar-like wall section 4 of the mating plug connector 2 will move into the attachment nut 32 axially and will move past the longitudinal section, having the front holding elements 58, of the contact carrying drum 12. During this movement the holding elements 58 will be impinged at a suitably shaped strike region 62—for example a spur-like radial projection—by the sleeve-like wall section 4 and shifted radially inward toward the base face of the groove-like recesses 35. When this happens they act on the inserted second plug contacts 6 and thrust same progressively against the first electrical conductors 43 so that an extremely dependable electrical contact is established.

Owing to the obliquely extending base face of the groove-like recesses 35 the clamping action is additionally enhanced.

In certain circumstances it is possible to do without the holding elements 58, if during use of the plug device practically no vibrations are likely and owing to other radial precautions reliable contact may be made between the first and the second plug contacts 24 and 6.

Once the attachment nut 32 is tightened the drum socket 53 is reliably sealed off from the surroundings. This results inter alia because, the sleeve-like wall section 4—on having its front edge section 63 (which is opposite to the floor 3) thrust against the housing 14—is pressed coaxially into a first annular sealing projection 64, which is formed integrally with the housing 14 of the outgoing cable part 8 and concentrically surrounds the drum socket 53.

As a further sealing measure the window-like openings 37, which delimit the channel-like plug sockets 42 to the rear side 22 of the contact carrying drum 12, are sealed off by adhesive 65 which flows into position by capillary attraction. Furthermore, at the outer periphery of the contact carrying drum 12 a second annular sealing projection 66 (formed on the outer periphery of the contact carrying drum 12) seals off the end section, facing the circuit substrate 15, of the drum socket 53 from the surroundings, said projection 66 being formed on the housing 14 of the outgoing cable part 8.

The above described rotational lock between the outgoing cable part 8 and the contact carrying drum 12 may be based on frictional contact between the two components. However in the case of need, as in the working example, an additional interlocking effect may be provided for.

In order to cause the interlock teeth 67 are provided on the contact carrying drum 12, such teeth being more especially integral with the drum 12 and axially facing toward the outgoing cable part 8 to bite into the material of the housing 14, when the contact carrying drum 12 is correspondingly displaced by the mating plug connector 2. Special recesses on the housing 14 are not required, if the housing material is sufficiently elastic in order to render possible penetration of the teeth 67.

The design of FIGS. 12 through 15 resembles that of FIGS. 1 through 11 with the sole exception that the circuit substrate 15*a* and the means for providing the first and the second abutment type contact faces 25 and 26 in the manner already indicated are different and by way of example the holding elements 58 are omitted.

FIGS. 16 and 17 indicate a modified contact carrying drum 12, as regards which something has already been said above in connection with a possible design of the means for producing the second abutment type contact faces 26. Furthermore in the case of this contact carrying drum 12 the support body 23 is composed of a plurality of components, that is to say an elongated core 68, on which two head parts 72 and 73 are mounted from opposite sides. The core 68 comprises a plastic material which initially is completely metallized on the outer periphery, and from which systematic removal of material has been performed to machine electrical conductors as necessary for producing the first plug contacts 24 (not illustrated). This machining may be implemented for example by incision into the metal layer surrounding the outer face. On the outer periphery of the core 68 there is moreover a positioning groove 74 extending in the longitudinal direction into which positioning projections fit, which are provided on the inner periphery of the head parts 72 and 73, when the head parts 72 and 73 are put on.

Finally the design of FIGS. 18 and 19 is basically identical to that of FIGS. 1 through 11, but in the case of the first plug contacts 24, in lieu of channel-like plug sockets for pin-like second plug contacts plug mating plug connector 2, contact pins 75 are present, which project on the axial front side 21 of the contact carrying drum 12 are present and are adapted for plugging into complementary sleeve-like second plug contacts of the mating plug connector 2. The plug connector 2 in accordance with FIGS. 18 and 19 consequently constitutes a sleeve or bushing whereas in the case of the other working examples it is in each case in the form of a plug.

The first plug contacts 24 in this case comprise furthermore first electrical conductors 43, which extend in groove-like recesses 35 in the outer periphery of the support body 23 and which are locally bridged over by rib sections 76 so that then there are peripherally completely closed insertion openings 77, in which the contact pins 75 are firmly anchored with a simultaneous contacting of the first electrical conductors 43. The contact pins 75 may for example be enclosed or be laid in position are fixed in place by adhesive. Furthermore, direct molding of plastic material of the support body 23 around the pins is possible.

The contact pins 75 may be connected with the first electrical conductors 43 using a suitable contact material, as for example solder or conductive adhesive. As is the case with the other embodiments in this case as well stamping and bending techniques are applicable to the electrical conductors.

In the case of the use of stamping and bending technology instead of MID technology it is possible for sheet metal to be stamped into the required form, bent and then to have plastic molded around it. This molding operation may take place directly to produce the desired housing shape, it however being advantageous to produce a pre-molding as a core, which carries the stamped and bent part and on which the stamped and bent part is cut to produce the required individual wiring in order to then mold the plastic around it as the actual housing form.

As an alternative it is possible for the first electrical conductors 43 to also be formed by the inner faces of metal sleeves, which are anchored in the support body 23 of the contact carrying drum 12. For producing a resilient clamping force the metal sleeves may be at least partially slotted.

What is claimed is:

1. An electromechanical plug device comprising:

a plug connector, which is adapted for electrical and mechanical connection with a mating plug connector and which possesses an outgoing cable part having a circuit substrate provided for electrical connection with an outgoing cable and furthermore possesses a contact carrying drum supported for rotation about its longitudinal axis, the contact carrying drum having a front axial side and an axial rear side, the contact carrying drum having first plug contacts, which are accessible from the front axial side facing away from the outgoing cable part, the first plug contacts being able to be contacted electrically by second plug contacts of the mating plug connector the contact carrying drum axial rear side, facing the outgoing cable part, including first abutment type contact faces, which irrespective of the instantaneous relative position of rotation of the outgoing cable part and the contact carrying drum, are contacted or are able to be contacted by second abutment type contact faces provided axially oppositely on the circuit substrate, wherein the contact carrying drum is able to be moved in the direction of its longitudinal axis with limited extent in relation to the outgoing cable part so that it is able to be shifted away from the mating plug connector to be connected toward the circuit substrate, the first and the second abutment type contact faces being thrust against each other.

2. The plug device as set forth in claim 1, wherein the first and/or second abutment type contact faces are at least partially circular or circularly arcuate with a center of curvature on the longitudinal axis of the contact carrying drum.

3. The plug device as set forth in claim 2, wherein the other of the first and second abutment type contact faces cooperating with the partially circular or circularly arcuate abutment type contact faces are formed of resilient button contact elements.

4. The plug device as set forth in claim 2, wherein the partially circular or circularly arcuate abutment type contact faces are arranged concentrically to each other.

5. The plug device as set forth in claim 4, wherein the circular or circularly arcuate abutment type contact faces are at the same level.

6. The plug device as set forth in claim 5, wherein the circuit substrate is a printed circuit board.

7. The plug device as set forth in claim 1, allows a relative, angularly unlimited rotation between the outgoing cable part and the contact carrying drum.

8. The plug device as set forth in claim 1, comprising a tooth engaging means provided on the axial rear side of the contact carrying drum, the tooth engaging means being adapted to make an interlocking and rotationally locking engagement with the outgoing cable part.

9. The plug device as set forth in claim 1, wherein the contact carrying drum is a 3D-molded interconnect device component whose first plug contacts are at least in part constituted by electrical conductors produced by molded interconnect device technology.

10. The plug device as set forth in claim 1, wherein the contact carrying drum possesses channel-like plug sockets open toward the axial front side, which are adapted to receive pin-like second plug contacts of the mating plug connector and which peripherally are furnished with at least one electrical conductor belonging to the first plug contacts, the at least one conductor is able to be electrically contacted by the inserted second plug contacts.

11. The plug device as set forth in claim 10, wherein the channel-like plug sockets are delimited by resiliently elastic holding means placed at the outer periphery of the contact carrying drum, the holding means being able to be acted upon by the connected mating plug connector on the outside so that the holding means may thrust the pin-like second plug contacts, located in the respective plug socket inward radially into contact with the electrical conductors of the first plug contacts.

12. The plug device as set forth in claim 10, wherein the channel-like plug sockets have a trapezium-like cross section, both their base area and also their flanks converging toward the base area being clad with an electrical conductor of the first signal contacts.

13. The plug device as set forth in claim 10, wherein the plug sockets taper in cross section toward the axial rear side and toward the contact carrying drum so that the pin-like second plug contacts are thrust, during the connecting operation, progressively against laterally placed electrical conductors of the first plug contacts.

14. The plug device as set forth in claim 1, wherein the contact carrying drum has contact pins belonging to the first plug contacts, which contact pins project at the axial front side and are designed to fit into sleeve-like second plug contacts of the mating plug connector.

15. The plug device as set forth in claim 1, wherein the first and/or the second abutment type contact faces are constituted by a permanently elastic contact material, as for instance an electrically conductive sealant or a conductive adhesive.

16. The plug device as set forth in claim 1, wherein the outgoing cable part comprises a housing consisting of plastic material, in which the circuit substrate is embedded, more especially by having the material molded about it, and which possesses a drum socket leading to the contact making region with the second abutment type contact faces, into which socket the contact carrying drum is inserted, with its axial rear side to the fore, so as to be rotatable while being axially tethered.

17. The plug device as set forth in claim 16, wherein on the housing within the drum socket a first annular sealing projection, concentrically surrounding the contact carrying drum, is formed, against which projection a sleeve-like wall section, surrounding contact carrying drum, of the mating plug connector is thrust in the connected state with a sealing action.

18. The plug device as set forth in claim 16, comprising a second annular seal projection, surrounding the contact carrying drum and in sealing contact with it, said seal projection being formed on the housing within the drum socket.

19. The plug device as set forth in claim 1, comprising a contact carrying drum with a multi-part support body with a core which is initially completely metallized and to produce the first signal contacts is machined, on which core two head parts are mounted from two opposite sides, of which head parts the head part located at the axial rear side bears on the first abutment type contact faces.

20. The plug device as set forth in claim 1, wherein the plug connector is designed in the form of an elbow connector.

21. An electromechanical plug device comprising:

a plug connector, which is adapted for electrical and mechanical connection with a mating plug connector;

the plug connector including an outgoing cable part having a circuit substrate adapted for electrical connection with an outgoing cable, and a contact carrying drum supported for rotation about its longitudinal axis, the contact carrying drum having a front axial side and an axial rear side, the contact carrying drum having first plug contacts, which are accessible from the front axial side facing away from the outgoing cable part, the first plug contacts adapted to electrically contact second plug contacts of the mating plug connector, the contact carrying drum axial rear side, faces the outgoing cable part, and includes first abutment type contact faces, which, irrespective of the instantaneous relative position of rotation of the outgoing cable part and the contact carrying drum, are contactable to second abutment type contact faces provided axially oppositely on the circuit substrate, and wherein the contact carrying drum is a 3D-molded interconnect device component, and the first plug contacts are at least in part constituted by electrical conductors in the form of a metallized layer formed on the contact carrying drum by molded interconnect device technology and integral therewith.

22. An electromechanical plug device comprising:

a plug connector, which is adapted for electrical and mechanical connection with a mating plug connector, the plug connector including an outgoing cable part having a circuit substrate adapted for electrical connection with an outgoing cable, and a contact carrying drum supported for rotation about its longitudinal axis, the contact carrying drum having a front axial side and an axial rear side, the contact carrying drum having first plug contacts, which are accessible from the front axial side facing away from the outgoing cable part, the first plug contacts adapted to electrically contact second plug contacts of the mating plug connector, the contact carrying drum axial rear side, faces the outgoing cable part, and includes first abutment type contact faces, which, irrespective of the instantaneous relative position of rotation of the outgoing cable part and the contact carrying drum, are contactable to second abutment type contact faces provided axially oppositely on the circuit substrate, and wherein the contact carrying drum includes groove-like recesses in communication with channel-like plug sockets open toward the axial front side, the plug sockets are adapted to receive pin-like second plug contacts of the mating plug connector, a metal coating being formed on, and integral with, the periphery of at least one of the groove-like recesses of the contact carrying drum forming at least one conductor which is part of the first plug contacts, and the at least one electrical conductor is able to be electrically contacted by the inserted second plug contacts.

* * * * *